US011538627B2

(12) United States Patent
Kondo

(10) Patent No.: US 11,538,627 B2
(45) Date of Patent: Dec. 27, 2022

(54) IGNITION COIL

(71) Applicant: DENSO CORPORATION, Kariya (JP)

(72) Inventor: Yuki Kondo, Kariya (JP)

(73) Assignee: DENSO CORPORATION, Kariya (JP)

( * ) Notice: Subject to any disclaimer, the term of this patent is extended or adjusted under 35 U.S.C. 154(b) by 151 days.

(21) Appl. No.: 17/171,322

(22) Filed: Feb. 9, 2021

(65) Prior Publication Data

US 2021/0249186 A1 Aug. 12, 2021

(30) Foreign Application Priority Data

Feb. 10, 2020 (JP) ..... JP2020-020341

(51) Int. Cl.
*H01F 38/12* (2006.01)
*H01F 27/26* (2006.01)

(52) U.S. Cl.
CPC ..... *H01F 38/12* (2013.01); *H01F 27/263* (2013.01); *H01F 2038/122* (2013.01); *H01F 2038/127* (2013.01)

(58) Field of Classification Search
CPC .. H01F 38/12; H01F 27/263; H01F 2038/122; H01F 2038/127; H01F 27/306; H01F 27/00–40
See application file for complete search history.

(56) References Cited

U.S. PATENT DOCUMENTS 5,349,320 A * 9/1994 Suzuki ..... H01F 27/02 336/107
5,764,124 A * 6/1998 Nakamichi ..... H01F 38/12 336/107
2018/0366269 A1 12/2018 Hori

FOREIGN PATENT DOCUMENTS

JP H08-045753 2/1996
JP 2015-201555 11/2015
JP 2016-174035 9/2016

* cited by examiner

*Primary Examiner* — Tuyen T Nguyen
(74) *Attorney, Agent, or Firm* — Nixon & Vanderhye P.C.

(57) ABSTRACT

An ignition coil includes a primary coil, a secondary coil, a center core, a magnet body and an outer peripheral core. The outer peripheral core is provided with a first opposite side, a second opposite side and a coupling side, the first opposite side facing the magnet body from an opposite side of the center core, the second opposite side facing the center core from the opposite side of the magnet body, the coupling side coupling the first opposite side with the second opposite side. The center core has a magnet side flange portion disposed at an end portion in a magnet body side, protruding in a protrusion direction. A thick portion is formed at both of a part of the first opposite side and a part of the coupling side, and a thickness of the thick portion being larger than a minimum thickness of the second opposite side.

5 Claims, 25 Drawing Sheets

IGNITION COIL

The present application claims the benefit of priority based on Japanese Patent Application No. 2020-020341 filed on Feb. 10, 2020, the entire disclosure of which is incorporated herein by reference.

BACKGROUND

Technical Field

The present disclosure relates an ignition coil.

Description of the Related Art

An example of a conventional art discloses an ignition coil provided with a primary coil and a secondary coil magnetically coupled with each other, a center core disposed inside the primary and secondary coils, and an annular-shaped outer peripheral core formed to surround the center core.

SUMMARY

The present disclosure provides an ignition coil capable of suppressing an energy loss when converting the primary energy into the secondary energy. One aspect of the present disclosure is an ignition coil including a primary coil, a secondary coil, a center core, a magnet body and an outer peripheral core. The outer peripheral core is provided with a first opposite side, a second opposite side and a coupling side, the first opposite side facing the magnet body from an opposite side of the center core, the second opposite side facing the center core from the opposite side of the magnet body, the coupling side coupling the first opposite side with the second opposite side. The center core has a magnet side flange portion disposed at an end portion in a magnet body side, protruding in a protrusion direction. A thick portion is formed at both of a part of the first opposite side and a part of the coupling side, and a thickness of the thick portion being larger than a minimum thickness of the second opposite side.

DETAILED DESCRIPTION OF THE PREFERRED EMBODIMENTS

As an example of a conventional art, Japanese Patent Application Laid-Open Publication Number 1996-045753 discloses an ignition coil provided with a primary coil and a secondary coil magnetically coupled with each other, a center core disposed inside the primary and secondary coils, and an annular-shaped outer peripheral core formed to surround the center core. The center core and the outer peripheral core form a closed magnetic path allowing magnetic flux produced by energization of the primary coil to pass therethrough. The ignition coil cuts off the energization of the primary coil to change an amount of magnetic flux formed in the closed magnetic path, thereby inducing high secondary voltage at the secondary coil.

Further, the ignition coil disclosed in the above-described patent literature is provided with a magnet body disposed in a gap between the center core and the outer peripheral coil with respect to the coil axial direction. The magnet body is used to apply a magnetic bias to the closed magnetic path so as to increase the secondary voltage and the secondary energy. The magnet body is magnetized in a direction opposite to the direction of a magnetic field produced in the closed magnetic path in response to the energization of the primary coil, which increases an amount of change in the magnetic flux in the closed magnetic path when the energization of the primary coil is cut off. Thus, the secondary voltage and the secondary energy in the secondary coil can be enhanced.

Further, according to the ignition coil disclosed in the above-described patent literature, the center core has a flange portion at an end portion in a side where the magnet body is disposed, protruding towards the outer peripheral side. Thus, the area of the end portion in the side where the magnet body is disposed can be larger. Thus, the cross-sectional area of the magnet body can be larger while facing the end portion of the center core. Hence, the magnetic field due to the magnetic bias can be strengthened.

According to the ignition coil disclosed in the above-described patent literature, from a point of view of reducing the energy loss when converting the primary electrical energy inputted to the primary coil to the secondary electrical energy, the configuration should be further improved. In other words, magnetic saturation tends to occur in the vicinity of the flange portion of the center core in the outer peripheral core and large flux leakage which does not contribute the energy conversion may occur between the outer peripheral core and the flange portion.

Hereinafter, with reference to the drawings, embodiments of the present disclosure will be described.

First Embodiment

Figure 1:
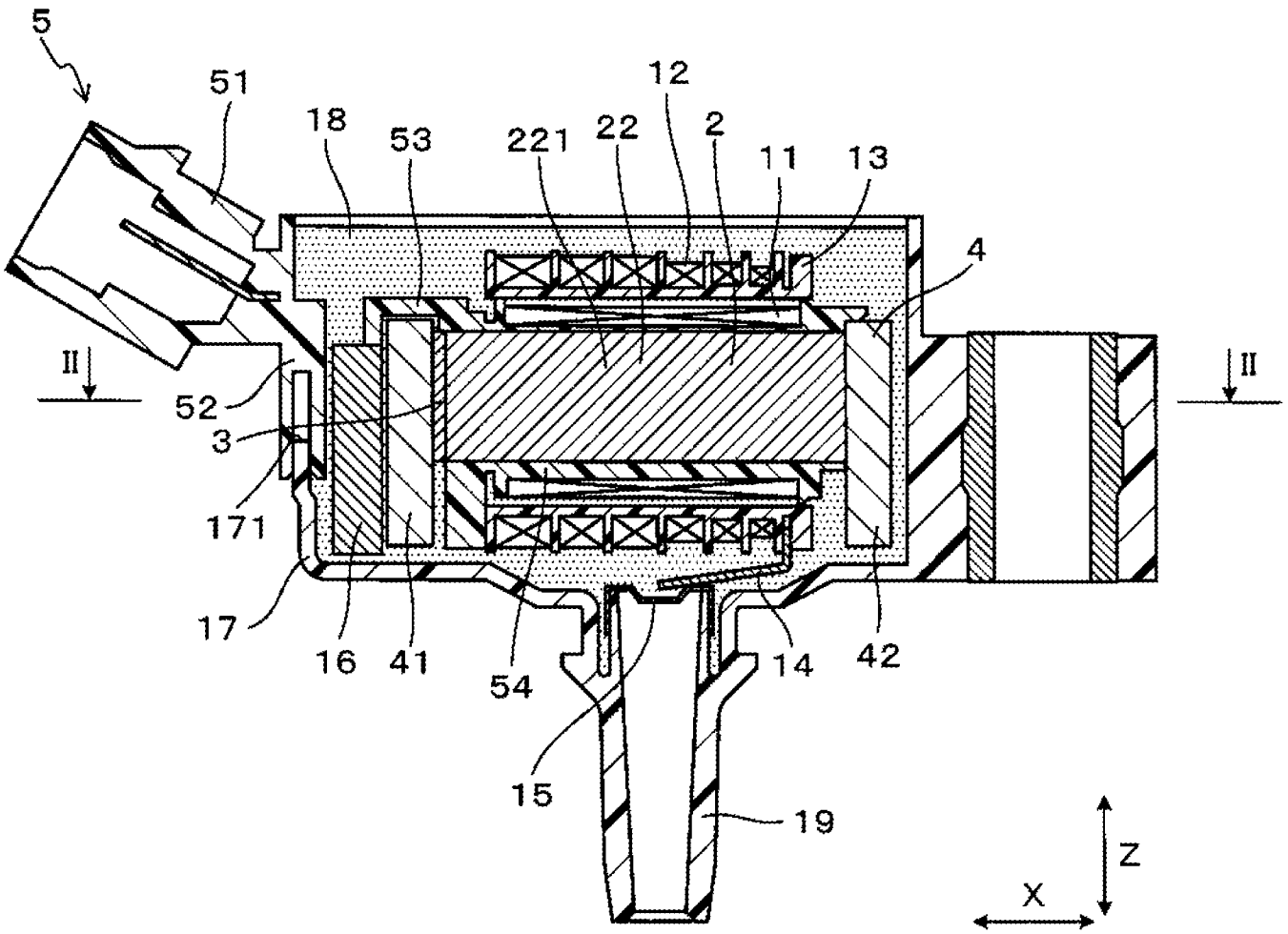
FIG. 1 is a cross-sectional view of an ignition coil cording to a first embodiment of the present disclosure.
Figure 2:
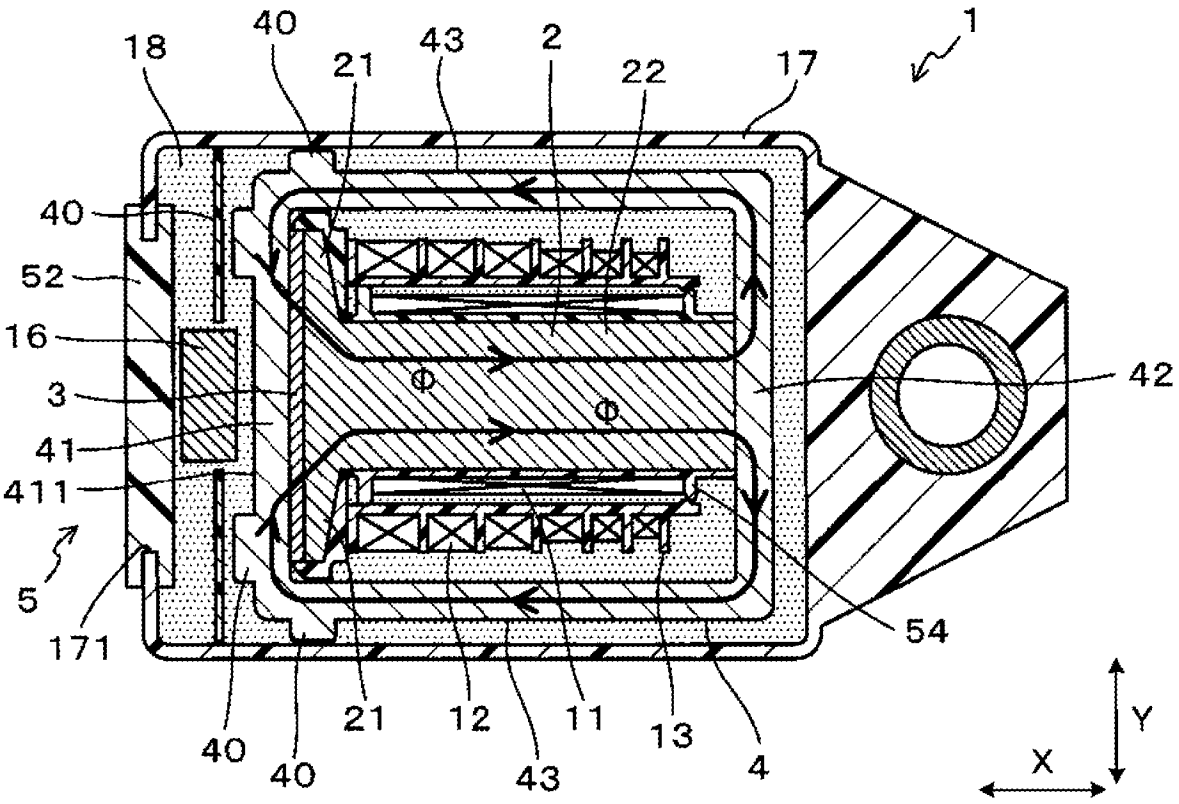
FIG. 2 is an cross-sectional view along II-II line of FIG. 1.

With reference to FIGS. 1 to 5, an embodiment of an ignition coil will be described. As shown in FIGS. 1 and 2, the ignition coil according to the present embodiment is provided with a primary coil 11, a secondary coil 12, a center core 2, a magnet body 3 and an outer peripheral core 4.

The primary coil 11 and the secondary coil 12 are magnetically coupled with each other. The center coil 2 is disposed at an inner peripheral side of the primary coil 11 and the secondary coil 12. The magnet body 3 is disposed at one side of the center core 3 in the coil axial direction X.

Figure 3:
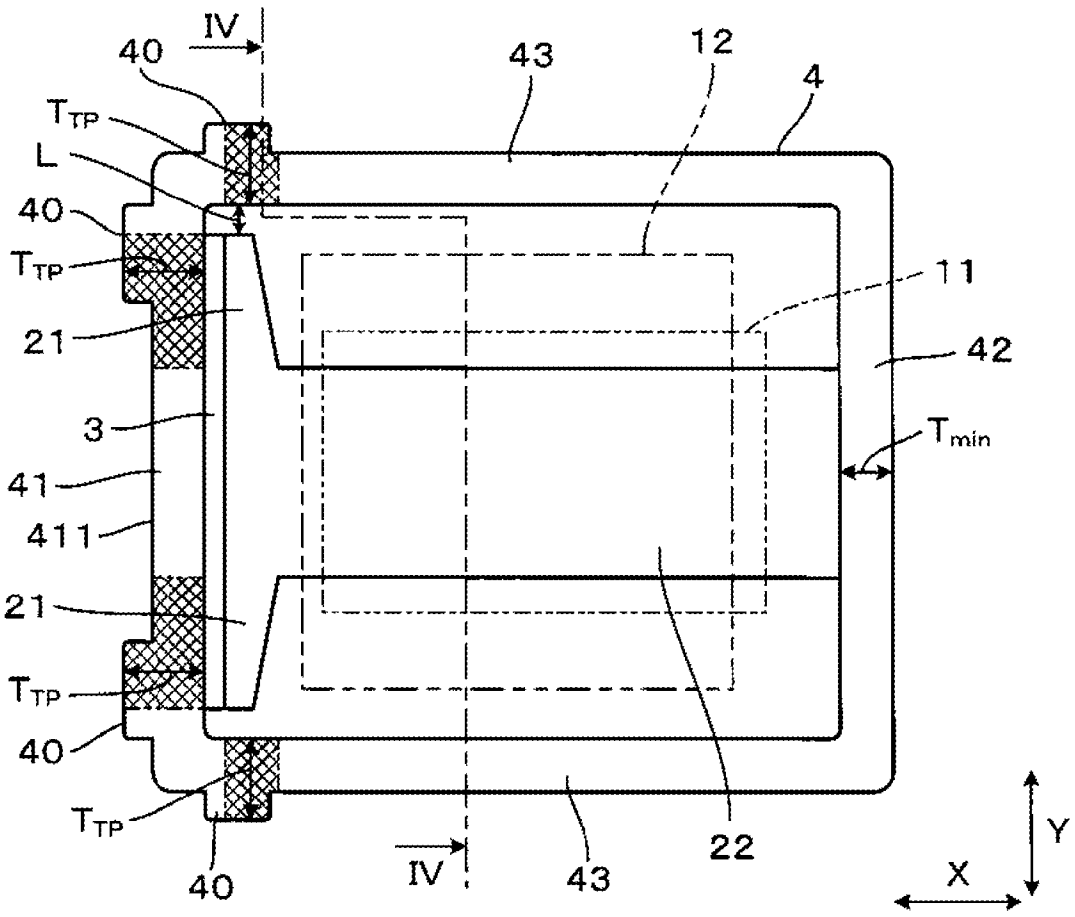
FIG. 3 is a plan-view showing a center core, a magnet body and an outer peripheral core according to the present embodiment.

As shown in FIGS. 2 and 3, the outer peripheral core 4 is provided with a first opposite side 41, a second opposite side 42 and a coupling side 43. The first opposite side 41 faces the magnet body 3 from the opposite side of the center core. The second opposite side 42 faces the center core 2 from the opposite side of the magnet body 3. The coupling sides 43 couple the first opposite side 41 with the second opposite side 42.

The center core 2 has a magnet side flange portion 21 at an end portion in the magnet body 3 side, protruding in a protrusion direction Y orthogonal to the coil axial direction X. A thick portion 40 is formed at at least a part of the first opposite side 41 which overlaps the magnet side flange portion 21 in the coil axial direction X and at least a part of the coupling side 43 which overlaps at least either the magnet side flange portion 21 or the magnet body 3 in the protrusion direction Y. The thickness Ttp of the thick portion 40 is larger than the minimum thickness Tmin of the second opposite side 42. Note that hatching is applied, for the sake of convenience, to the portion of the first opposite side 41 which overlaps the magnet side flange portion 21 in the coil axial direction X, and the portion of the coupling side 43 which overlaps the magnet side flange portion 21 and the magnet body 3. Hereinafter, the present embodiment will be described in detail.

In this specification, the coil axial direction X is a direction in which the winding axis of the primary coil 11 and the secondary coil 12 extends. Hereinafter, the coil axis direction X is referred to as X direction. One side of the X direction and a side in which the magnet body 3 is provided is referred to as a front side, and the opposite side of the front side is referred to as a rear side. Note that the expressions of the front/rear side are used for the sake of convenience and do not limit the posture of disposition of the ignition coil 1 with respect to the vehicle to which the ignition coil 1 mounted. A direction orthogonal to the X direction, along which the magnet side flange portion 21 in the center core 2 protrudes is referred to as the Y direction. Further, a direction orthogonal to both of the X direction and the Y direction is referred to as the Z direction.

For example, the ignition coil 1 according to the present embodiment may be utilized for internal combustion engines such as vehicles and cogeneration devices. The ignition coil 1 is connected to a spark plug (illustration is omitted) provided for an internal combustion engine and used for means for applying high voltage to the spark plug.

As shown in FIGS. 1 to 3, the center core 2 is formed in the X direction as a longitudinal side. For example, the center core 2 is formed such that a plurality of electromagnetic steel sheet made of soft magnetic material having a thickness in the Z direction are laminated in the Z direction. As shown in FIG. 2, a cross-sectional shape perpendicular to the Z direction of the center core 2 has a substantially T-shape.

The center core 2 is provided with a columnar member 22 having a rectangular column shape extending in the X direction, and a pair of magnet side flange portions 21 protruding on both sides of the Y direction from the front end of the columnar member 22. The rear surface of the magnet side flange portion 21 is inclined towards the front side as it recedes from the columnar member 22. Thus, the magnet side flange portion 21 has a cross-sectional area orthogonal to the Y direction which becomes smaller as it recedes from the columnar member 22. The magnet side flange portion 21 occupies a large area in the center core 2, which allows the magnet body 3 having the cross-sectional area orthogonal to the X direction to be disposed in the front side of the center core 2. The magnet body 3 is provided to face the front surface of the center core 2 and contact therewith.

The magnet body 3 is formed in a rectangular plate shape having a thickness in the X direction. The size of the magnet body 3 when viewed from the X direction is the same as that of the front surface of the center core 2. The magnet body 3 is provided on substantially the entire surface of the front surface of the center core 2. The magnet body 3 applies a magnetic bias to the center core 2 to enhance the output voltage of the ignition coil 1 to increase a change amount of the magnetic flux φ formed, when the energization of the primary coil is cutoff, in the magnetic circuit configured by the center core 2 and the outer peripheral core 4, thereby increasing the voltage induced at the secondary coil 12. As long as the same material is used for the magnet body 3, the larger the cross-section of the magnet body 3, the larger the magnetic bias applied to the center core 2 is. The outer peripheral core 4 is provided to surround the center core 2 and the magnet body 3.

As shown in FIG. 3, the outer peripheral core 4 has a rectangular ring shape when viewed from the Z direction. For example, the outer peripheral core 4 is formed such that a plurality of electromagnetic steel sheet made of soft magnetic material having a thickness in the Z direction, are laminated in the Z direction. The outer peripheral core 4 is provided with the first opposite side 41, the second opposite side 42 and a pair of coupling sides 43. The first opposite side 41 is joined to the front surface of the magnet body 3 and extends in the Y direction. The second opposite side 42 is joined to the rear surface of the center core 42 and extends in the Y direction. The second opposite side 42 is joined to the rear surface of the center core 2 and extends in the Y direction. One coupling side 43 in the pair of coupling side 43 couples one end of the first opposite side 41 and one edge of the second opposite side 42 in the Y direction and extends in the X direction.

As shown in FIG. 3, according to the present embodiment, the thick portion 40 is formed at the first opposite side 41 and the pair of coupling sides 43. As described above, the thickness Ttp of the thick portion 40 is larger than the minimum thickness Tmin of the second opposite side 42.

The first opposite side 41 includes the thick portions 40 at both ends thereof in the Y direction, which protrude towards the front side. The thick portions 40 are formed at portions overlapping with a protruded side end portions of the magnet side flange portion 21 (i.e. end portions away from the columnar member 22) in the X direction. The thick portions 40 of the first opposite side 41 are formed to portions overlapping with a gap between the magnet side flange portion 21 and the coupling portion 43 in the X direction. According to the present embodiment, the thick portions 40 are each formed at a portion of the outer peripheral portion core 4 overlapping with corresponding magnet side flange portion 21 in the X direction. However, only one thick portion 40 may be formed at a portion of the outer peripheral core 4 overlapping with at least one magnet side flange portion 21 in the X direction.

Figure 4:
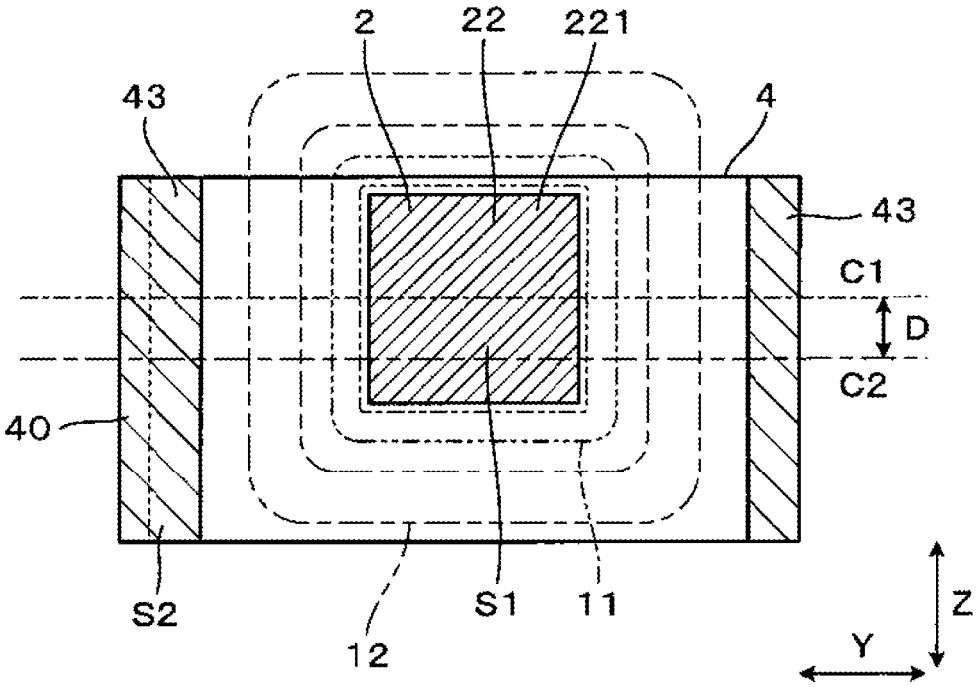
FIG. 4 is an arrow cross-sectional view sectioned along IV-IV line of FIG. 3.
Figure 5:
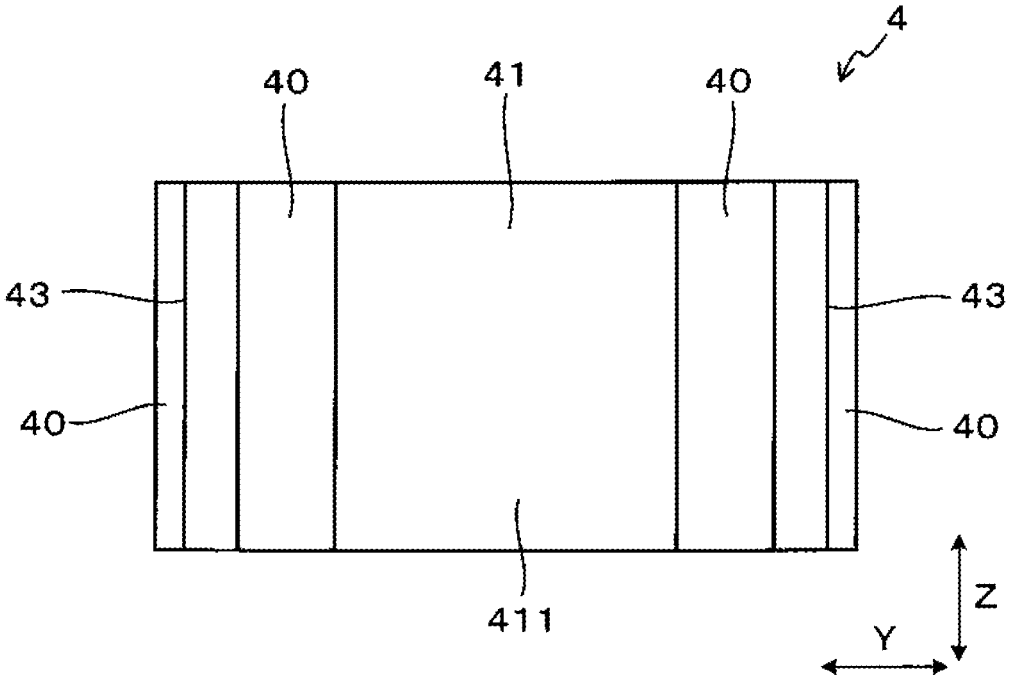
FIG. 5 is a front-view of an outer peripheral core according to the first embodiment.

Each coupling side 43 is provided with a thick portion 40 at the front end portion, which protrudes in the opposite side of the center core in the Y direction. The thick portion 40 of the coupling side 43 is formed at a portion overlapping with the magnet side flange portion 21 and the magnet body 3 in the Y direction. According to the present embodiment, the thick portion 40 is formed at each coupling side 43. However, the thick portion 40 may be formed in at least either one coupling side 43, at a portion overlapping with at least either the magnet side flange portion 21 or the magnet body 3 in the Y direction. As shown in FIGS. 4 and 5, the thick portion 40 of the first opposite side 41 and the thick portion 40 of the coupling portion 43 are formed from one end of the outer peripheral core 4 to the other end of the outer peripheral core 4 in the Z direction.

As shown in FIG. 3, the second opposite side 42 has substantially constant thickness through the entire portion in the Y direction, in which any portions of the second opposite side 42 in the Y direction have the minimum thickness Tmin of the second opposite side 42. The thickness Ttp of the thick portion 40 and the minimum thickness Tmin of the second side 42 are required to satisfy the condition of Ttp>Tmin. However, according to the present embodiment, the condition Ttp>1.15×Tmin is further satisfied.

As shown in FIG. 1, the length of the outer peripheral core 4 in the Z direction is larger than the lengths of the center core 2 and the magnet body 3 in the Z direction. The portions at both sides of the outer peripheral core 4 in the Z direction protrude from the center core 2 and the magnet body 3 towards both sides in the Z direction. As shown in FIG. 4, the center position C1 of an insertion portion 221 which is inserted into the inner peripheral side of the primary coil 11 and the secondary coil 12 of the center core 2 (i.e. part of columnar member 22) in the Z direction, and the center position C2 of the outer peripheral core 4 in the Z direction are different.

As shown in FIG. 4, an area of a cross-section orthogonal to the X direction in the insertion portion 221 of the center core 2 is defined as S1 [$mm^2$]. Further, an area of a cross-section of each thick portion 40 orthogonal to a magnetic path direction of the outer peripheral core 4 is defined as S2 [$mm^2$]. In other word, S2 refers to an area of a cross-section of the thick portion 40 which is parallel to the thickness direction of the thick portion 40 and the Z direction. As shown in FIG. 3, the distance between the magnet side flange portion 21 and the coupling side 43 in a direction where the coupling side 43 and the center core 2 are arranged (i.e. Y direction) is defined as L [mm]. L is smaller than the maximum length of each magnet side flange portion 21 in the X direction. As shown in FIG. 4, the distance between the center of the insertion portion 221 and the center of the outer peripheral core 4 in the Z direction is defined as D [mm].

S1, S2, L and D satisfy a condition $(2\times S2)/S1 \geq -0.189L+0.068D+1.998$. S2 of any thick portions 40 satisfies the equation. The ground of the equation will be described in the experiment examples which will be described later.

As shown in FIGS. 1 and 2, the center core 2 constitutes the connector module 5 which will be described later. The connector module 5 includes the center core 2, terminals of the connector portion 51 inside the metal mold constituting the connector module 5. The connector module 5 is integrally formed with the center core 2, and the terminals of the connector portion 51 by an insert molding method of injecting the resin into the metal molding. The connector module 5 includes a connector portion 51, an engaging wall 52, a connection wall 53, and a primary spool portion 54.

As shown in FIG. 1, the connector portion 51 is provided in the front end portion of the connector module 5. The connector portion 51 connects between the ignition coil 1 and external equipment. The engagement wall 52 is formed in a plate shape having a thickness in the X direction and engaged with a casing 17. The connector portion 51 protrudes towards the front side from the engaging wall 52. The connection wall 53 is provided to extend towards the rear side from the engaging wall 52. The connection wall 53 passes the first side 41 and one side of the magnet body 3 in the Z direction and connects between the engaging wall 52 and the primary spool portion 54. The primary spool portion 54 covers the center core 2 and the primary coil 11 wound around the outer peripheral portion. The center core 2 is provided in the primary spool portion 54 in a state where the front surface and the rear surface thereof are exposed from the primary spool portion 54.

In the outer peripheral side of the primary spool portion 54, a secondary spool portion 13 is provided. The secondary spool 13 is formed such that a resin or the like having electrical insulation property is formed in cylindrical shape. The secondary spool portion 13 includes the primary spool portion 54 inserted thereinside. The secondary coil 12 is wound around the secondary spool 13 from the outer peripheral side. The secondary coil 12 is formed coaxially with the primary coil 11.

As shown in FIG. 1, a connection terminal 14 is provided at a rear end portion of the secondary spool 13. The connection terminal 14 is connected to a high voltage side end portion of the secondary coil 12. The connection terminal 14 is connected to an output terminal 15 of the ignition coil 1. The output terminal 15 is provided to close the high voltage tower 19 having a cylindrical shape formed in the ignition coil 1. The output terminal 15 also serves as a valve to prevent a sealing resin 18 (described later) from being leaked outside the casing 17 through the high voltage tower 19 from the casing 17 of the ignition coil 1.

As shown in FIGS. 1 and 2, the ignition coil 1 is provided with an ignitor 16 disposed between the first opposite side 41 of the outer peripheral core 4 and the engaging wall 52. Here, as shown in FIG. 2, the front surface of the first opposite side of the outer peripheral core 4 includes a front concave portion 411 between the pair of thick portions 40 formed at the first opposite side 41. The front concave portion 411 is recessed from the thick portions 40 formed at the first opposite side 41 towards the rear side, and both sides in the Z direction are opened. Note that the front concave portion 411 may be formed as a slit penetrating through the first opposite side 41 in the X direction. At least part of the ignitor 16 is provided inside the front concave portion 411. In other words, at least a part of the ignitor 16 is accommodated in a rear side with respect to the front end of the front concave portion 411 (i.e. front end of the thick portion 40 of the first opposite side 41) in the X direction. Thus, heat produced by the ignitor 15 is likely to radiate towards the outer peripheral core 4, and also the ignition coil 1 can be shrunk in the X direction. Thus, the ignitor 16 controls energization and cutoff states of the primary coil 11.

As shown in FIGS. 1 and 2, components constituting the ignition coil 1 are accommodated in the casing 17 and a region inside the engaging wall 52 of the connector module 5 engaged with the casing 17. The casing 17 is made of electrical insulating resin. As shown in FIG. 1, the casing 17 is opened at one side in the Z direction. In the wall portion in the front side of the casing 17, an engaging concave portion 171 is formed to engage with the engaging wall 52. The engaging concave portion 171 is formed to have a shape in which a part of the wall portion in the front side of the casing 17 is cut in the Z direction from the opening end of the casing 17. The connector module 5 is assembled inside the casing 17 from the opening end of the casing 17 while making the engaging wall 52 of the connector module 5 engage with the engaging concave portion 171.

In a region surrounded by the casing 17 and the engaging wall 52, the sealing resin 18 is provided. The sealing resin 18 is made of, for example, a thermosetting resin having an electrical insulation property. The sealing resin 18 seals constituents of the ignition coil 1 accommodated in the region inside the casing 17 and the engaging wall 52.

Next, effects and advantages of the present embodiment will be described. According to the ignition coil 1 of the present embodiment, a thick portion 40 in which the thickness Ttp of the thick portion 40 is larger than the minimum thickness Tmin of the second opposite side 42, is formed at at least a part of the first opposite side 41 which overlaps the magnet side flange portion 21 in X direction and at least a part of the coupling side 43 which overlaps at least either the magnet side flange portion 21 or the magnet body 3 in the Y direction. Thus, the thick portion 40 is formed at a portion where magnetic saturation is likely to occur in the outer peripheral core 4, whereby the energy loss when converting the primary energy to the secondary energy can be suppressed.

Figure 6:
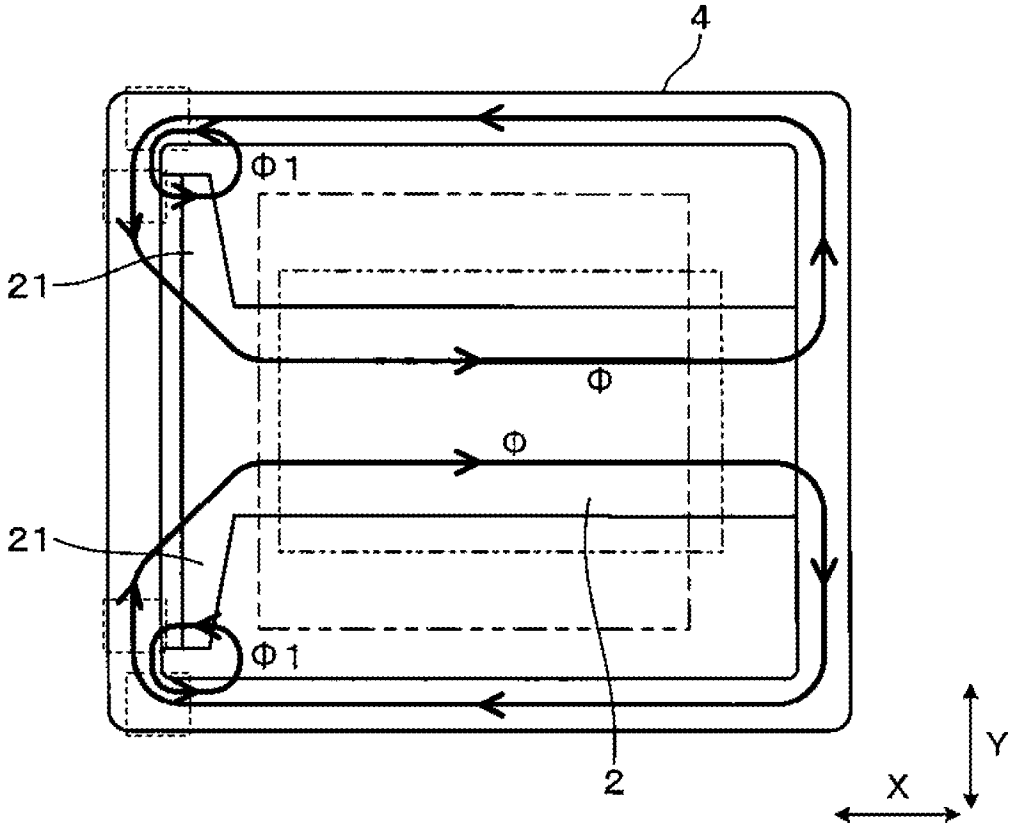
FIG. 6 is a plan view of a center core, a magnet body and an outer peripheral core according to a comparative embodiment, showing a state where a loop is formed without interlinkage with the primary coil and the secondary coil.

For example, as shown in FIG. 6, in the case where the thick portion 4 is not formed at the outer peripheral core 4, a magnetic saturation is likely to occur in a region surrounded by a dotted line shown in FIG. 6 (i.e. in the vicinity of a region overlapping the protruded side end portion of the magnet side flange portion 21 in the X direction and the in the vicinity of a region overlapping in the Y direction in the outer peripheral core 4). Hence, a part of magnetic flux $\phi 1$ is leaked outside the outer peripheral core 4 and the center core 2 at a portion of the outer peripheral core 4 in the vicinity of the protruded side end portion of the magnet side flange portion 21, to form a loop. The loop is formed in a path without interlinkage with the primary coil and the secondary coil. Therefore, in the case where such loops are formed, the energy loss when converting the primary energy to the secondary energy becomes larger.

In this respect, the thick portion 40 is provided according to the present embodiment, whereby the cross-section of a portion of the outer peripheral core 4 where the magnetic saturation is likely to occur, can be expanded. Hence, the above-described magnetic-flux loop which does not contribute the energy conversion from the primary energy to the secondary energy can be prevented from being formed. Accordingly, the energy loss can readily be suppressed according to the present embodiment.

As described, according to the present embodiment, an ignition coil capable of suppressing the energy loss when converting the primary energy to the secondary energy can be provided.

Second Embodiment

Figure 7:
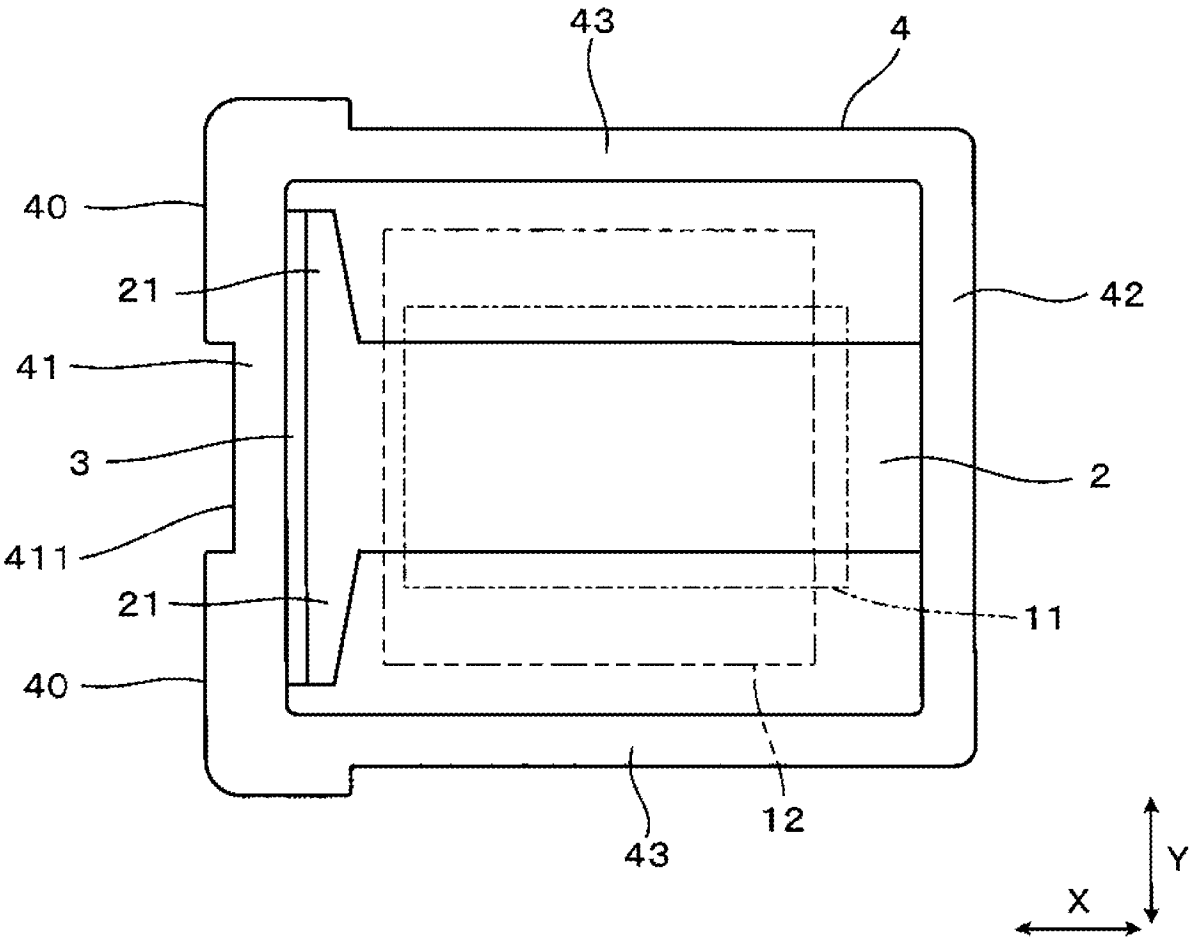
FIG. 7 is a plan-view showing a center core, a magnet body and an outer peripheral core according to a second embodiment.

According to the present embodiment, as shown in FIG. 7, the shape of outer peripheral core 4 is changed comparing with the first embodiment.

According to the present embodiment, a thick portion 40 is formed over a portion of the first opposite side 41 which overlaps the magnet side flange portion 21 in the X direction and a portion of the coupling side 43 which overlaps the magnet side flange portion 21 in the Y direction. The thick portion 40 formed at the first opposite side 41 is formed at a portion overlapping substantially entire magnetic side flange portion 21 in the X direction. The front concave portion 411 is formed between the pair of thick portions 40 formed at the first opposite side 41. When viewed from the Z direction, entire front concave portion 411 is formed at a portion overlapping substantially the entire columnar member 22 in the X direction.

Other configurations are the same as those in the first embodiment. The same reference numbers as those used in the existing embodiments among the reference numbers used in the second embodiment and the latter embodiments represent the same constituents in the existing embodiments unless other wise specified.

According to the present embodiment, a cross-sectional area orthogonal to the magnetic path can be secured in the vicinity of a corner portion between the first opposite side 41 and the pair of coupling sides 43 in the outer peripheral core 4. Hence, magnetic saturation in the outer peripheral core 4 can be further suppressed. Accordingly, the energy loss when converting the primary energy to the secondary energy can be suppressed.

Moreover, the entire front concave portion 411 is formed at a portion overlapping substantially the entire columnar member 22 in the X direction, when viewed from the Z direction. Here, magnetic flux is unlikely to concentrate at the portion of the first opposite side 41 overlapping the columnar member 22 in the X direction when viewed from the Z direction, so that a magnetic saturation is unlikely to occur. Hence, the front concave portion 411 is formed at this portion, whereby weight of the outer peripheral core 4 can be reduced, and also the manufacturing cost thereof can be reduced without lowering the magnetic characteristics. Other than this, effects and advantages similar to the first embodiment can be obtained.

Third Embodiment

Figure 8:
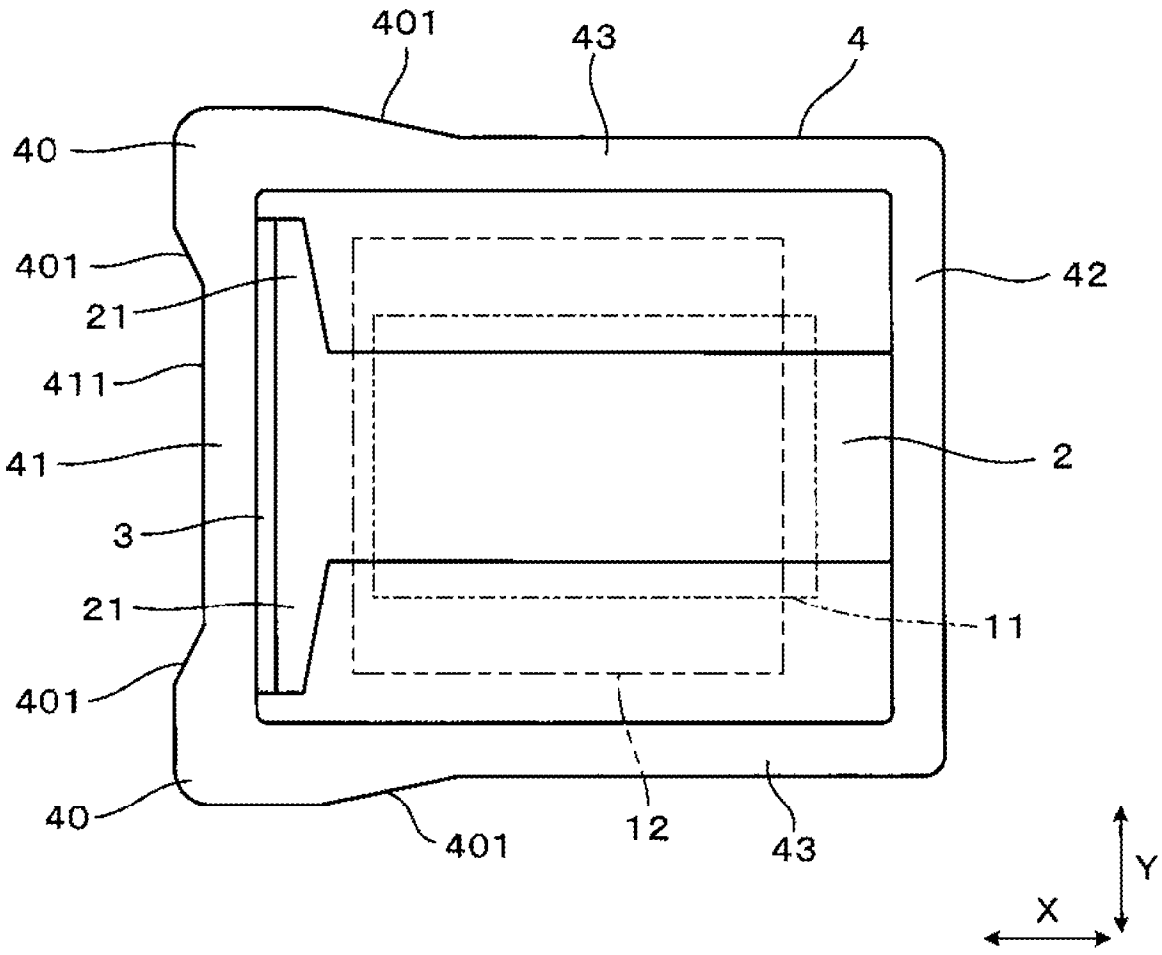
FIG. 8 is a cross-sectional view showing a center core, a magnet body and an outer peripheral core according to a third embodiment.

According to the present embodiment, as shown in FIG. 8, the shape of the outer peripheral core 4 is modified comparing with the first embodiment. Note that the circumferential direction of the annular-shaped outer peripheral core 4 is referred to as a core circumferential direction. In other words, the core circumferential direction refers to an annular direction along the outer peripheral core 4 when viewed from the X direction. Further, an inner peripheral side of the outer peripheral core 4 is referred to as a core inner peripheral side and an outer peripheral side of the outer peripheral core 4 is referred to as a core outer peripheral side.

The outer peripheral surface of the thick portion 40 includes a taper surface 401 at both ends in the core circumferential direction. The taper surface 401 is inclined towards the core inner peripheral side as it approaches the end of the thick portion in the core circumferential direction. The taper surface 401 formed on the coupling side 43 is formed towards the rear side with respect to the magnet side flange portion 21. The taper surface 401 formed on the first side 41 is formed at a portion overlapping the protruded side end portion in the X direction. Other configurations are the same as those in the second embodiment.

According to the present embodiment, the taper surfaces 401 are formed at both ends of the outer peripheral surface of the thick portion 40 in the core circumferential direction. Hence, edges can be prevented from being formed at both ends of the thick portion 40 on the outer peripheral surface in the core circumferential direction. As a result, cracks on the sealing resin occurring from the above-described edges as the origin can be suppressed. Other than this feature, effects and advantages similar to the second embodiment can be obtained.

Fourth Embodiment

Figure 9:
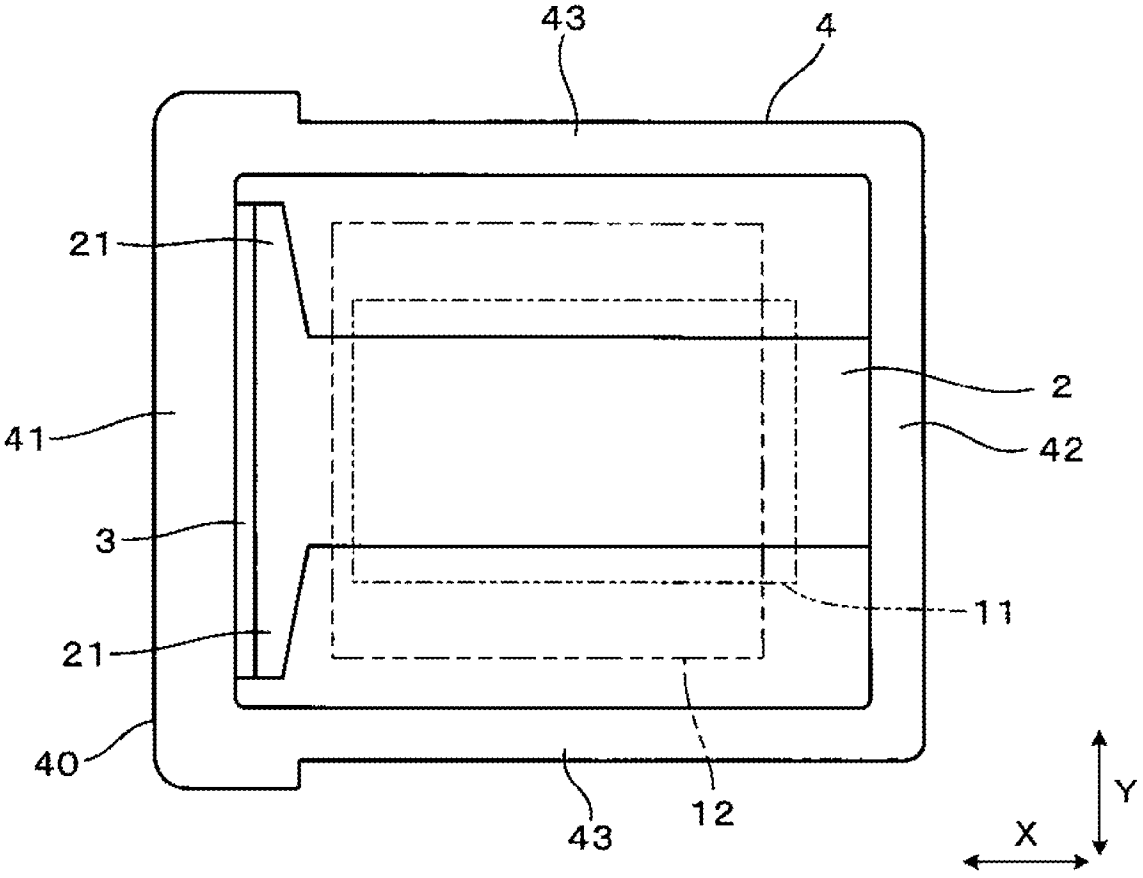
FIG. 9 is a cross-sectional view showing a center core, a magnet body and an outer peripheral core according to a fourth embodiment.

According to the present embodiment, as shown in FIG. 9, the shape of the outer peripheral core 4 is modified comparing with the second embodiment.

According to the present embodiment, the thick portion 40 is formed over the front end portion of one coupling side 43 and the front end portion of the other coupling side 43 via the first opposite side 41. In other words, the entire first opposite side 41 is formed as the thick portion 40 and also the front end portion 43 adjacent to the first opposite side 41 is formed as the thick portion 40. Other configuration is the same as those in the second embodiment.

According to the present embodiment, effects and advantages similar to the first embodiment can be obtained.

Fifth Embodiment

Figure 10:
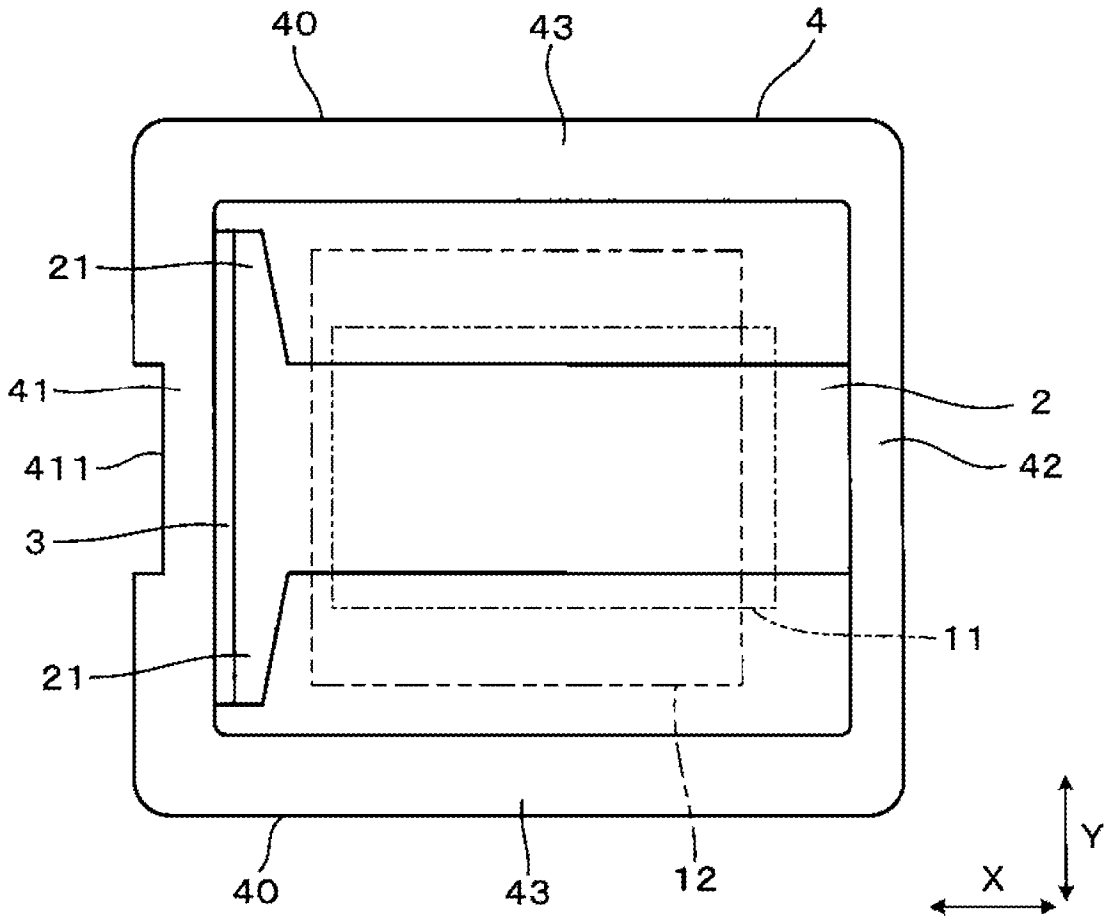
FIG. 10 is a cross-sectional view showing a center core, a magnet body and an outer peripheral core according to a fifth embodiment.
Figure 11:
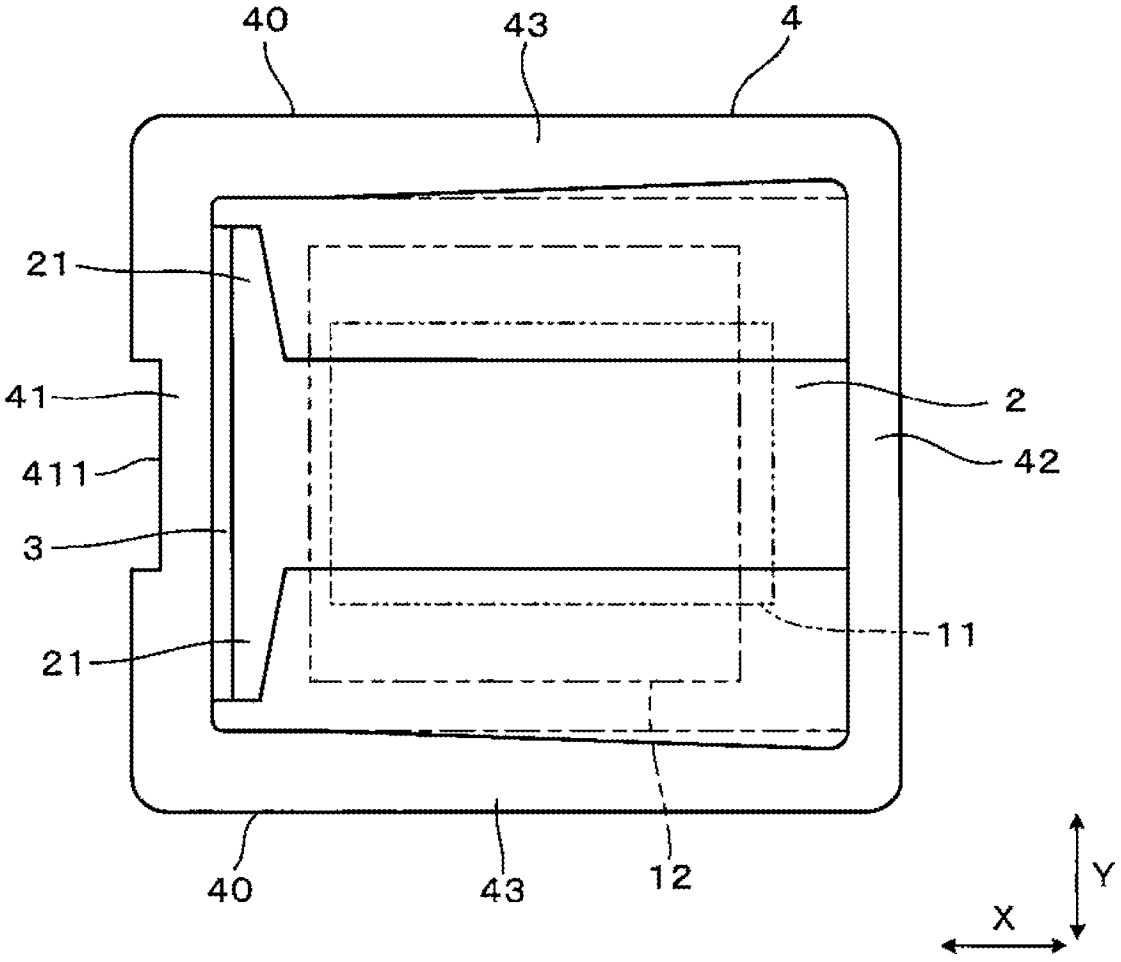
FIG. 11 is a cross-sectional view showing a center core, a magnet body and an outer peripheral core according to a sixth embodiment.

According to the present embodiment, as shown in FIG. 10, each coupling side 43 is formed as the thick portion 40. Other configurations are the same as those in the second embodiment.

According to the present embodiment, effects and advantages similar to the second embodiment can be obtained.

Sixth Embodiment

According to the present embodiment, the surface shape of core inner peripheral side of the coupling side 43 is changed comparing with the fifth embodiment. According to the present embodiment, substantially the entire surface in the core inner peripheral side of the coupling side 43 is inclined so as to move away from the center core 2 as it goes towards the rear side. Also, according to the present embodiment, the voltage of the secondary coil 12 becomes higher as it approaches the rear end side.

According to the present embodiment, the coupling side 43 of the outer peripheral core 4 can be disposed to be farther from the high voltage portion of the secondary coil 12 (i.e. rear end portion of the secondary coil 12). Hence, the electrical insulation property can readily be secured between the outer peripheral core 4 and the secondary coil 12.

Seventh Embodiment

According to the present embodiment, as shown in FIGS. 12 to 20, the shape of the outer peripheral core 4 and the center core 2 are changed comparing with the first embodiment.

Figure 12:
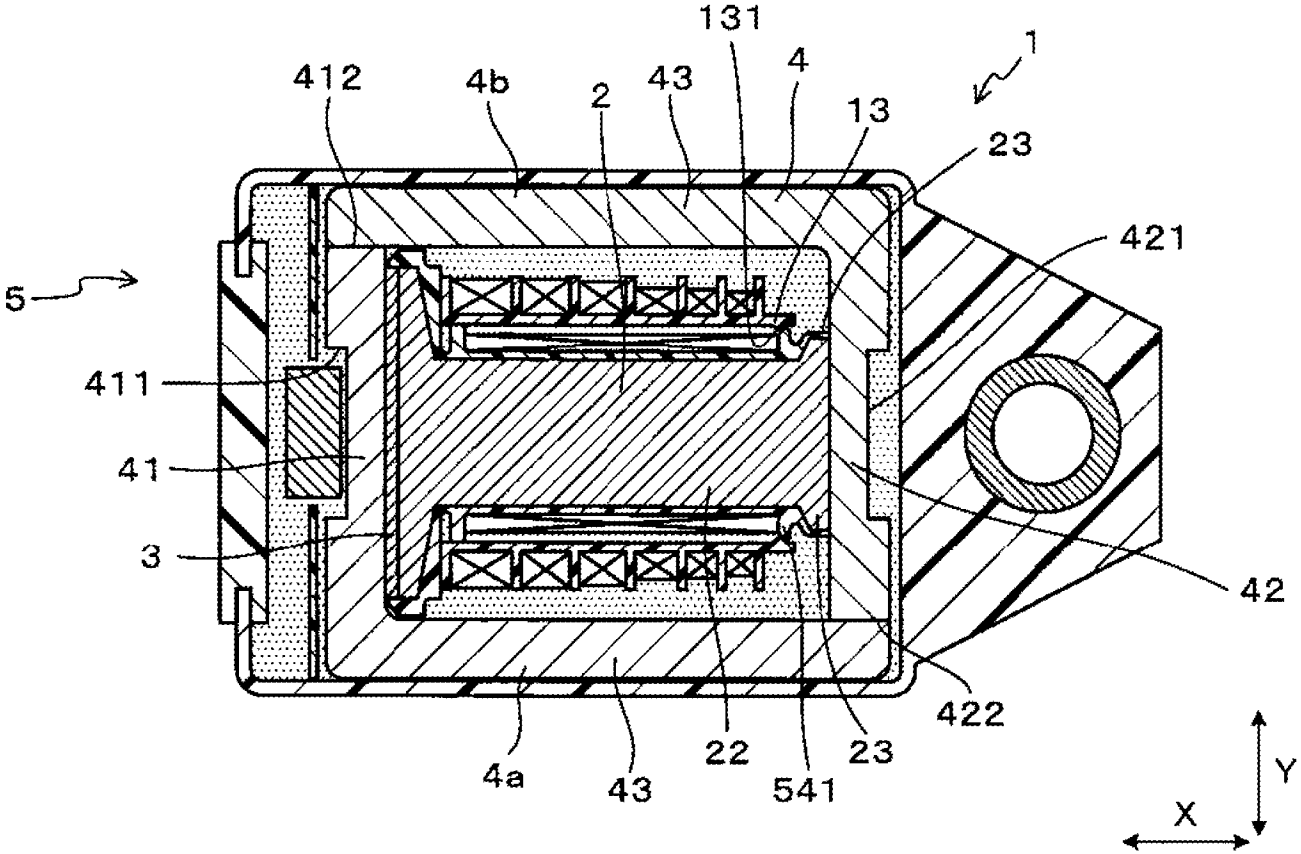
FIG. 12 is a cross-sectional view showing an ignition coil sectioned along a direction parallel to both of a coil axial direction and a protruding direction of a magnet side flange portion according to the seventh embodiment.
Figure 13:
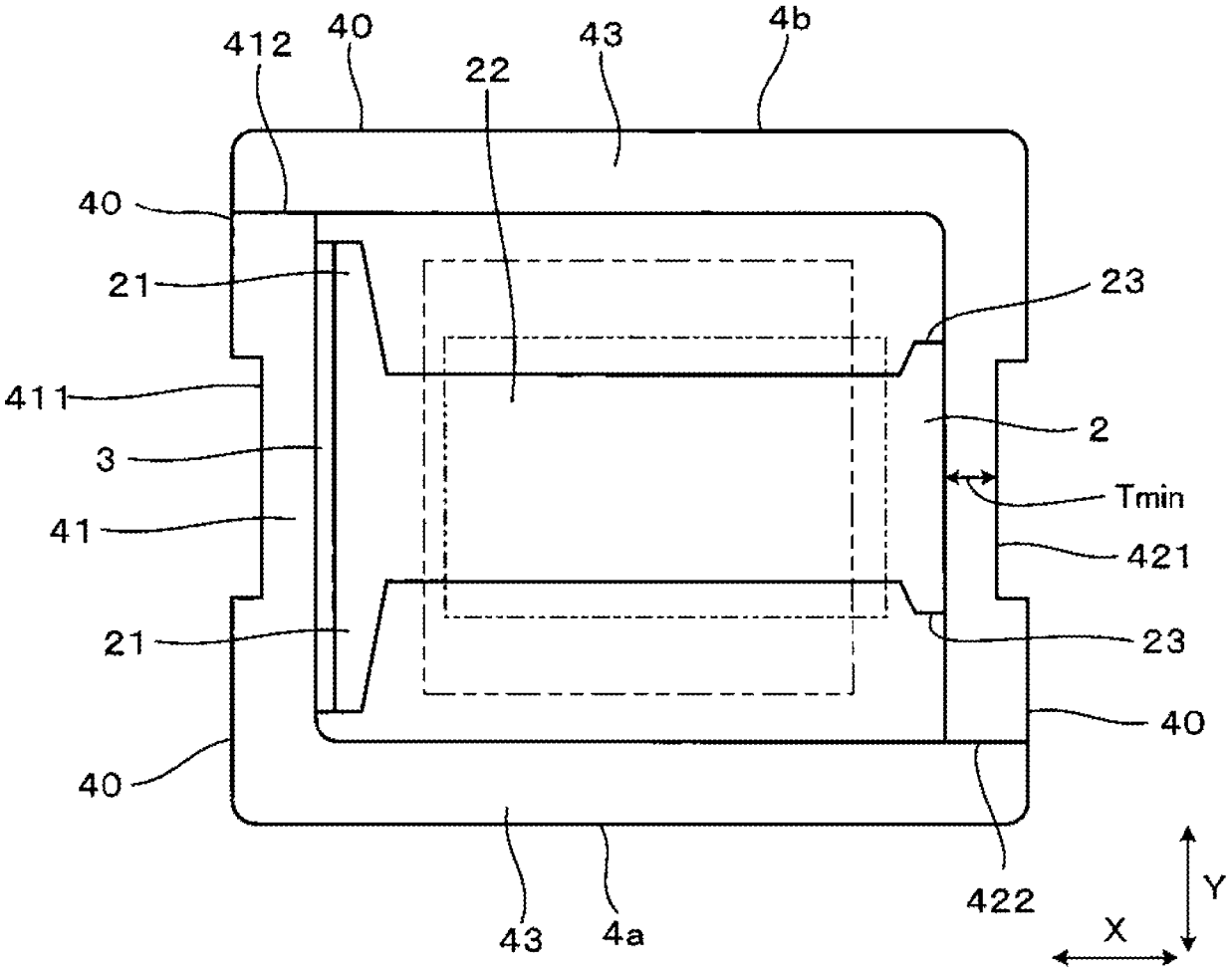
FIG. 13 is a cross-sectional view showing a center core, a magnet body and an outer peripheral core according to the seventh embodiment.
Figure 14:
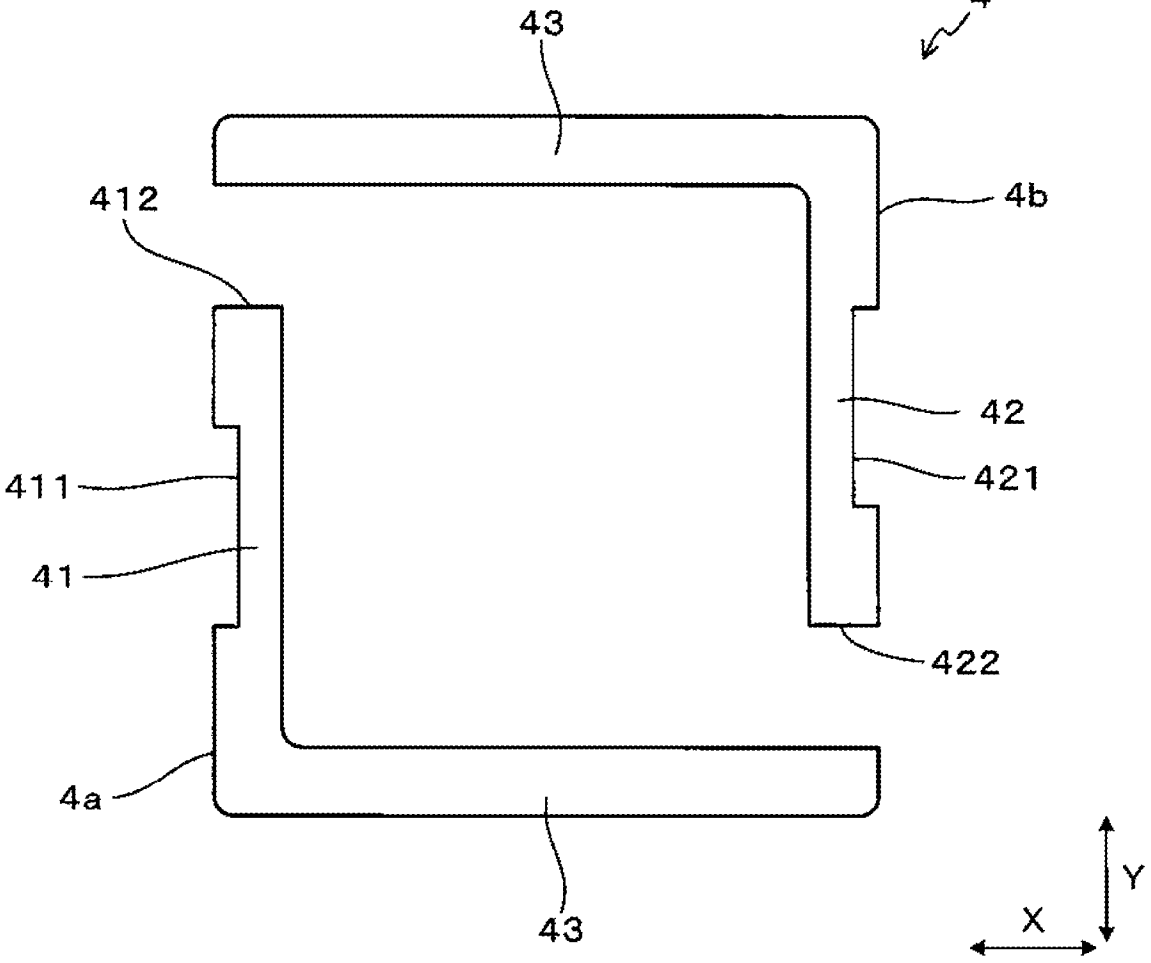
FIG. 14 is a disassembled plan view of an outer peripheral core according to the seventh embodiment.

As shown in FIGS. 12 to 14, the outer peripheral core 4 is configured to have an annular shape by combining a first divided core 4*a* and a second divided core 4*b*. The first divided core 4*a* is provided with a first opposite side 41 and one coupling side 43, and the second divided core 4*b* is provided with a second opposite side 42 and the other coupling side 43. The first divided core 4*a* and the second divided core 4*b* are each formed in the same L-shape, having the same shape. The first divided core 4*a* and the second divide core 4*b* are assembled such that respective postures are rotated by 180 degrees each other in the core circumferential direction. For the first divided core 4*a* and the second divided core 4*b*, an end face 412 of the first opposite side 41 in the Y direction and a front end portion of the coupling side 43 of the second divided core 4*b* are in contact with each other, and an end face 422 of the second opposite side 42 in the Y direction and a rear end portion of the coupling side 43 are in contact with each other.

The outer peripheral core 3 is provided with the above-described front concave portion 411 at the first opposite side 41 of the first divided core 4*a* and the rear concave portion 421 at the second opposite side 42 of the second divided core 4*b*. The rear concave portion 421 is formed at a portion overlapping with a rear surface of the center core 2 in the X direction, in which both sides in the Z direction are open.

The overall portion other than a portion where the front concave portion 411 and the rear concave portion 421 of the outer peripheral core 4 are formed constitutes the thick portion 40. In other words, as shown in FIG. 13, the overall portion other than a portion where the front concave portion 411 and the rear concave portion 421 of the outer peripheral core 4 are formed has a thickness larger than the minimum thickness Tmin of the second opposite side 42. The minimum thickness Tmin of the second opposite side 42 is a dimension in the X direction of a portion where the rear concave portion 421 is formed in the X direction. The contact portion between the first divided core 4*a* and the second divided core 4*b* are constituted by the thick portion 40.

As shown in FIGS. 12 and 13, the end portion of the center core 2 opposite to (i.e. rear side) the magnet body 3 of the center core 2 has a rear flange portion 23 protruding outside the rear concave portion 421 in the Y direction. The rear flange portion 23 protrudes towards both sides in the Y direction from the columnar member 22 of the center core 2. The front surface of the rear flange portion 23 is inclined towards the rear side as it recedes from the columnar member 22. Thus, the rear flange portion 23 has a cross-sectional area orthogonal to the Y direction which becomes smaller as it goes apart from the columnar member 22. The rear flange portion 23 located at one side in the Y direction protrudes towards one side in the Y direction than the rear concave portion 421, and the rear flange portion 23 located at the other side in the Y direction protrudes towards the other side in the Y direction than the rear concave portion 421.

When viewed from the X direction, a region where the rear flange portion 23 of the center core 2 in the X direction is present, is formed to be accommodated within the inner peripheral side with respect to a portion constituting the minimum inner diameter of the secondary spool 13. Thus, in the case where the secondary spool 13 is mounted to the connector module 5 which will be described later, the secondary spool 13 is prevented from affecting the rear flange portion 23. As shown in FIG. 12, the inner peripheral surface of the secondary spool 13 includes a locking portion 131 (described later) protruding towards the inner peripheral side at the rear end portion, and a region where the locking portion is formed constitutes the minimum inner diameter of the secondary spool 13. In other words, the region where the rear flange portion 23 of the center core 2 in the X direction is present, is formed to be accommodated within the inner peripheral side with respect to the locking portion 131 of the secondary spool 13 when viewed from the X direction. According to the present embodiment, a part of the primary spool 54 is formed at the outer peripheral portion of the rear flange portion 23 of the center core 2, and the part of the primary spool portion 54 is also formed to be accommodated inside the minimum inner diameter portion of the secondary spool 13 when viewed from the X direction.

The locking portion 131 is locked by a locked portion 541 formed in the primary spool 54. Thus, the secondary spool 13 is positioned with respect to the connector module 5 including the primary spool 54.

Next, with reference to FIGS. 15 to 20, an example of a method for mounting the secondary spool 13, the first divided core 4*a* and the second divided core 4*b* to the connector module 5 will be described.

Figure 15:
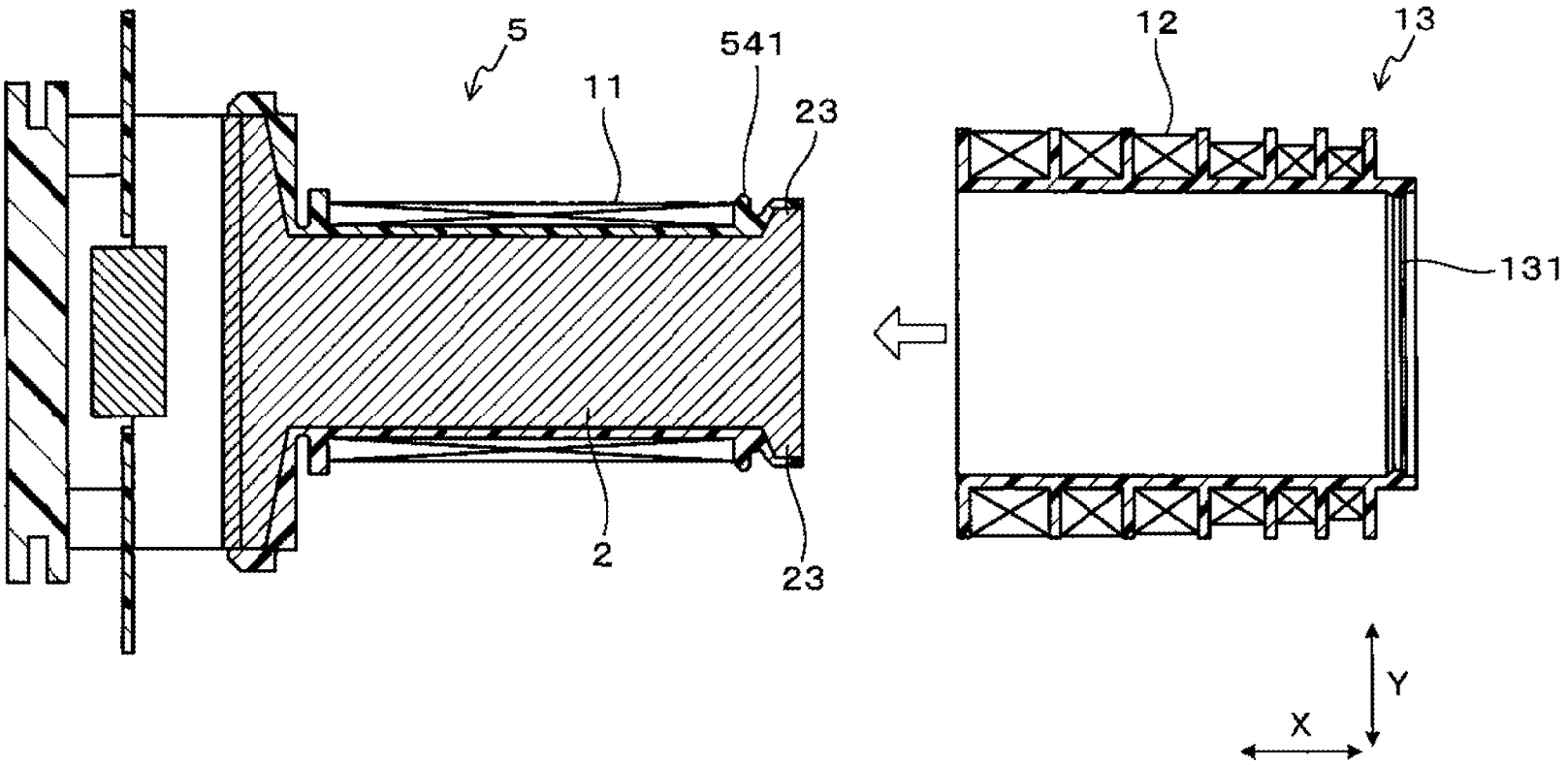
FIG. 15 is a cross-sectional view showing a state before a secondary spool is assembled to a connector module according to the seventh embodiment.
Figure 16:
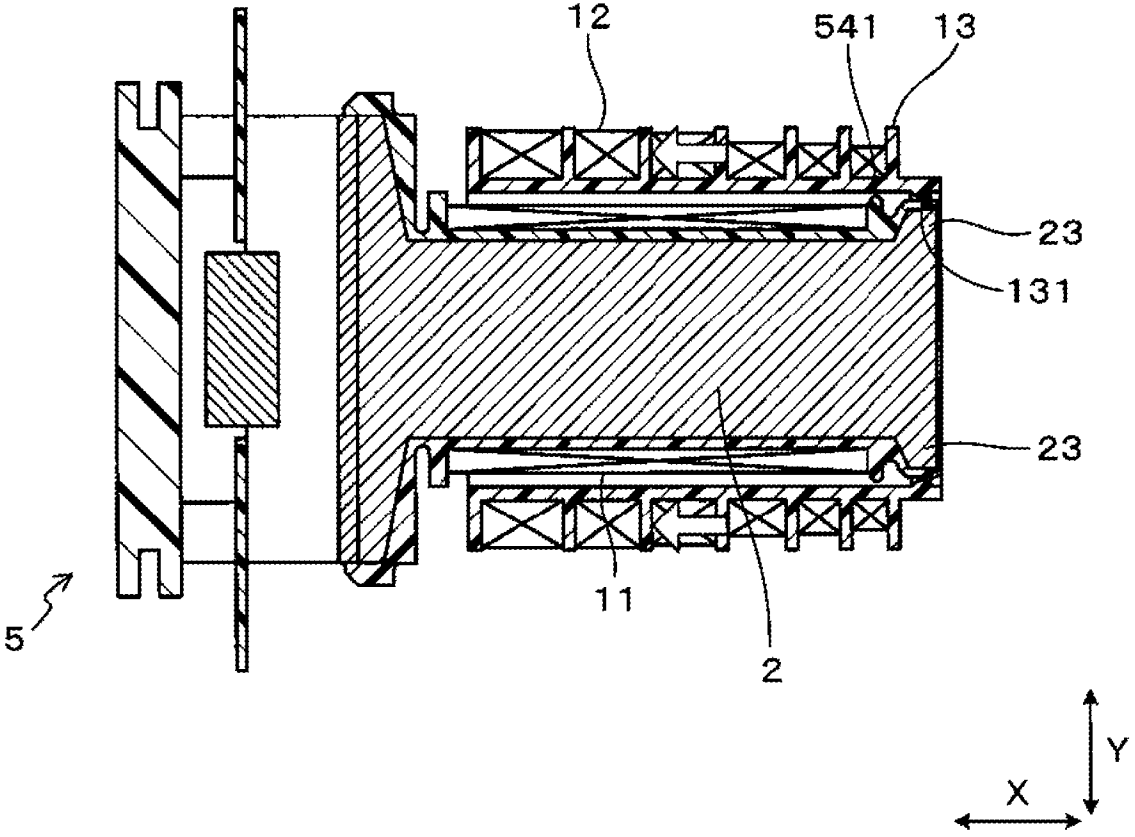
FIG. 16 is a cross-sectional view showing a state where a locking portion of the secondary spool passes a rear flange portion of the center core.
Figure 17:
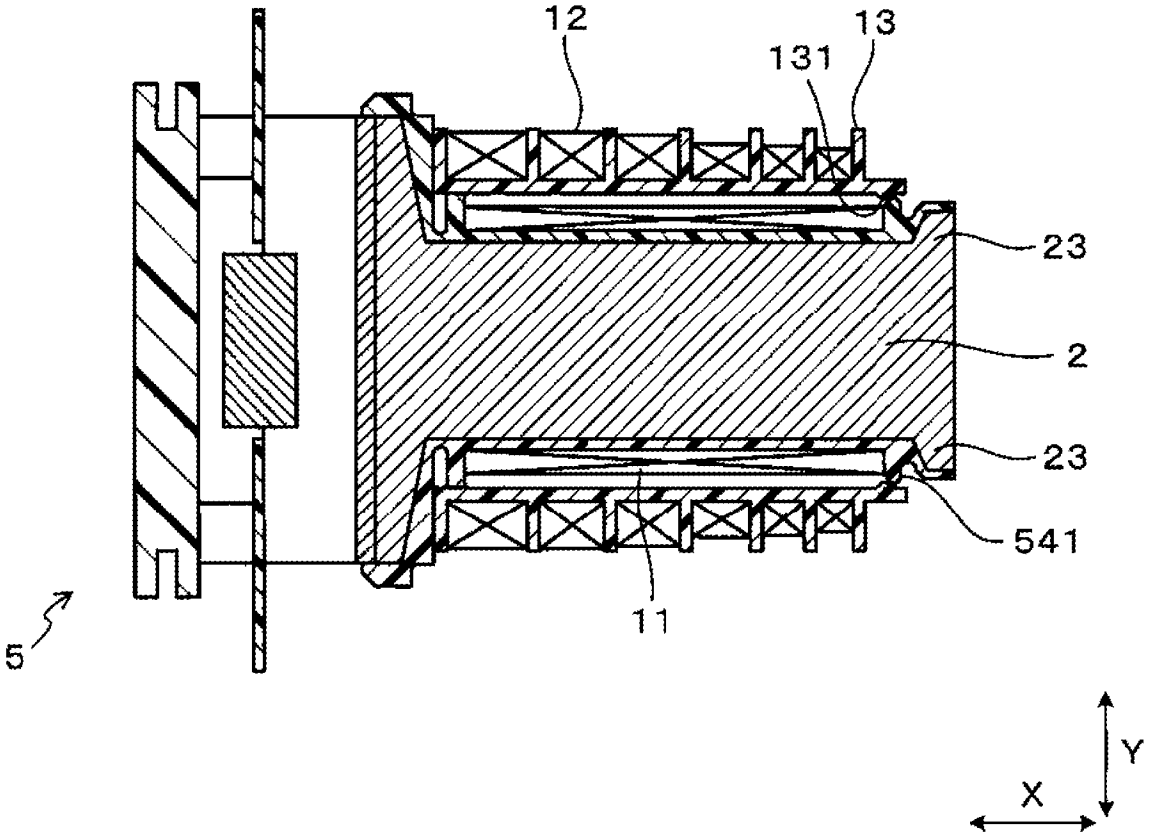
FIG. 17 is a cross-sectional view showing a state where the secondary spool is assembled to the connector module.

As shown in FIGS. 15 to 17, the secondary spool 13 is mounted to the connector module 5. The secondary spool 14 is mounted to the connector module such that the center core 2 and the primary spool 54 inserted inside the secondary spool 13. At this time, as described above, the region where the rear flange portion 23 of the center core 2 in the X direction is present, is formed to be accommodated within the inner peripheral side with respect to the secondary spool 13 when viewed from the X direction. Hence, the secondary spool 13 is able to pass through the rear flange portion 23 without interfering the rear flange portion 23. Then, the locking portion 131 of the secondary spool 13 gets over the locked portion 541 of the primary spool 54, whereby the locking portion 131 of the secondary spool 13 is locked at the locked portion 541, and the secondary spool 13 is positioned with respect to the connector module 5 as shown in FIG. 17.

Figure 18:
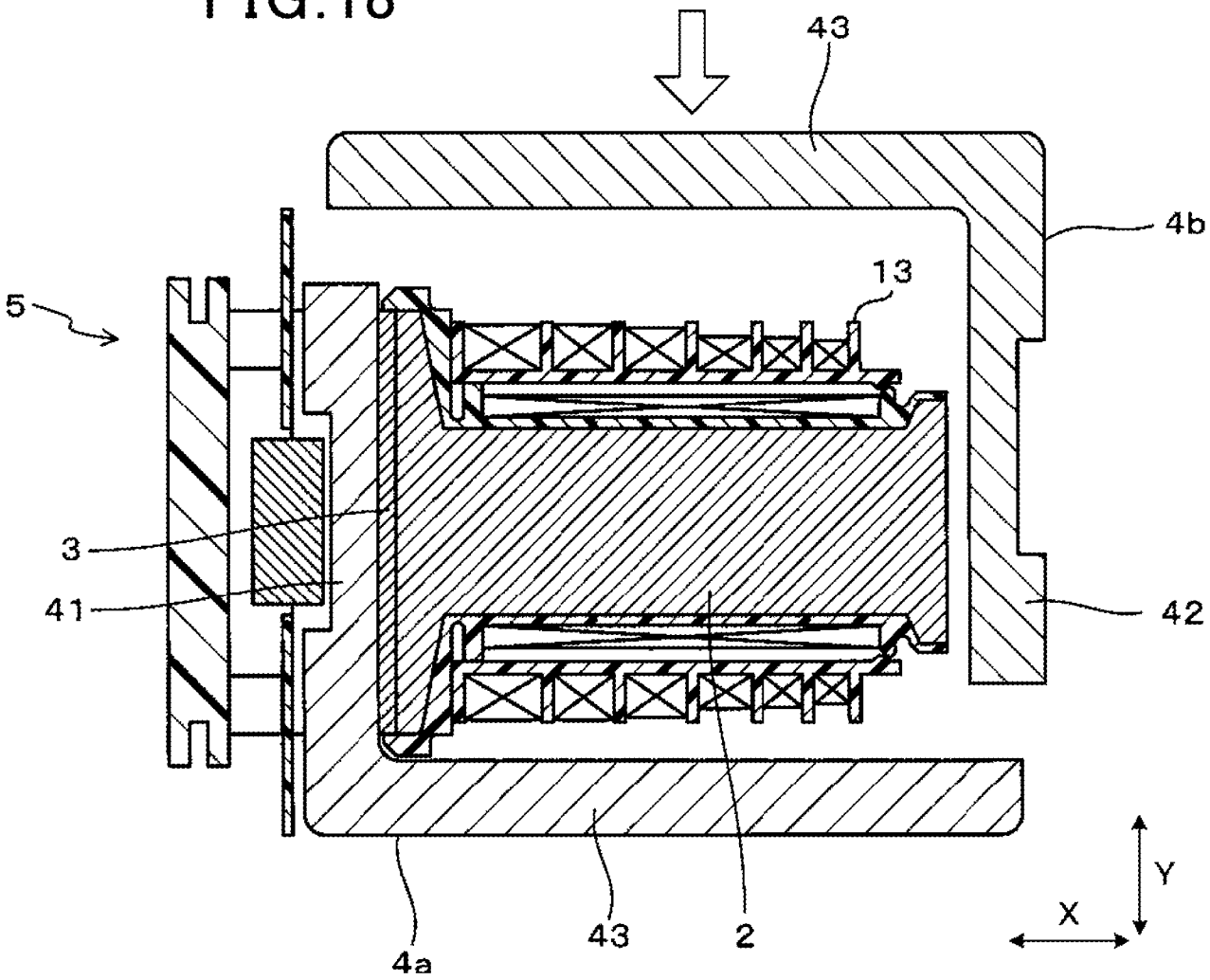
FIG. 18 is a cross-sectional view for explaining a state where the outer peripheral core is assembled to the connector module, and showing a state where the second divided core approaches a first divided core assembled to the connector module.

Next, as shown in FIG. 18, the first divided core 4*a* is mounted to the connector module 5 such that the first opposite side 41 of the first divided core 4*a* is disposed forward the magnet body 3 disposed on the front surface of the center core 2. Then, the first opposite side 41 of the first divided core 4*a* is fixed to the magnet body 4 with the magnetic force.

Figure 19:
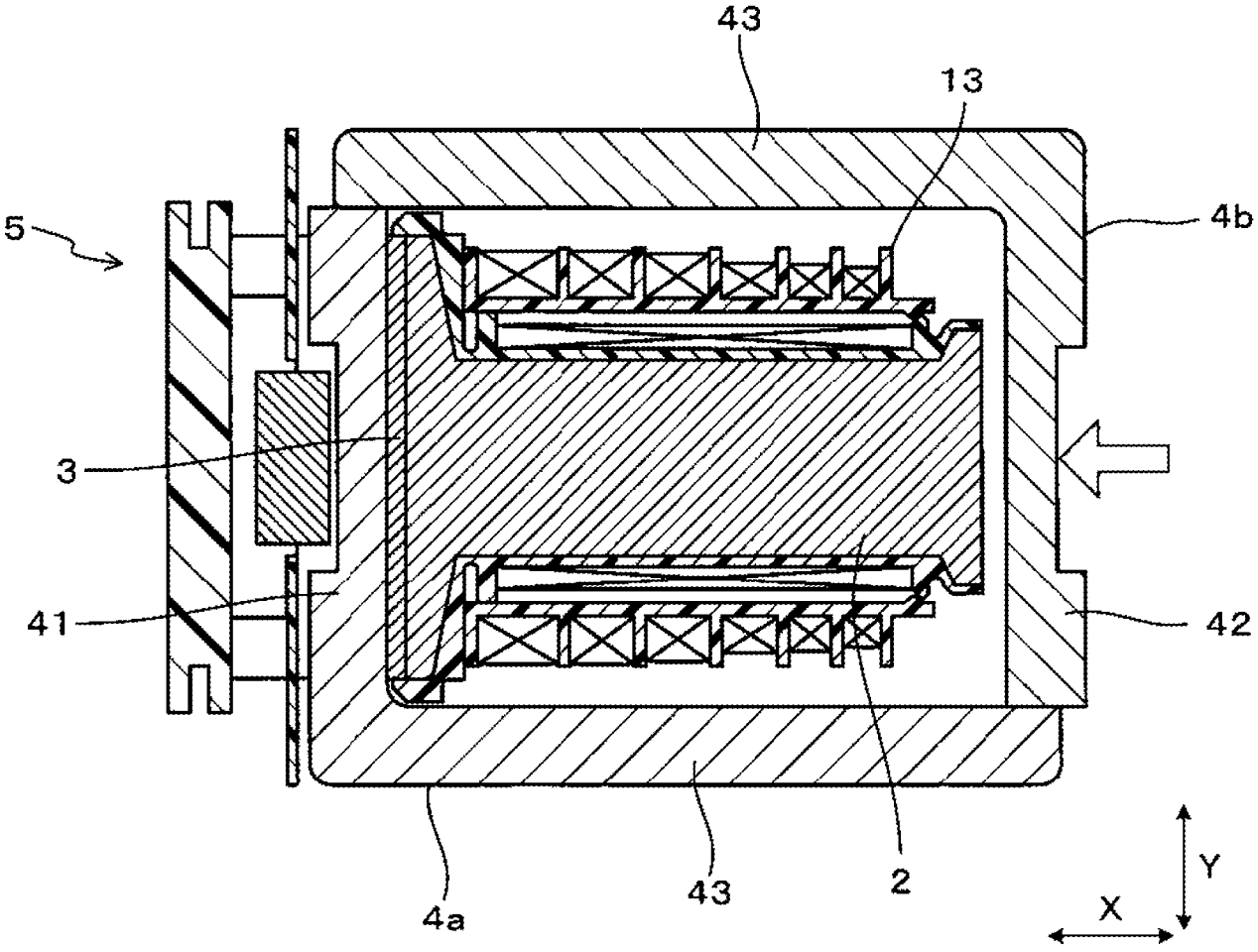
FIG. 19 is a cross-sectional view for explaining a state where the outer peripheral core is assembled to the connector module, and showing a state where the first core and the second divided core are contacted with each other in the protruding direction of the magnet side flange portion.
Figure 20:
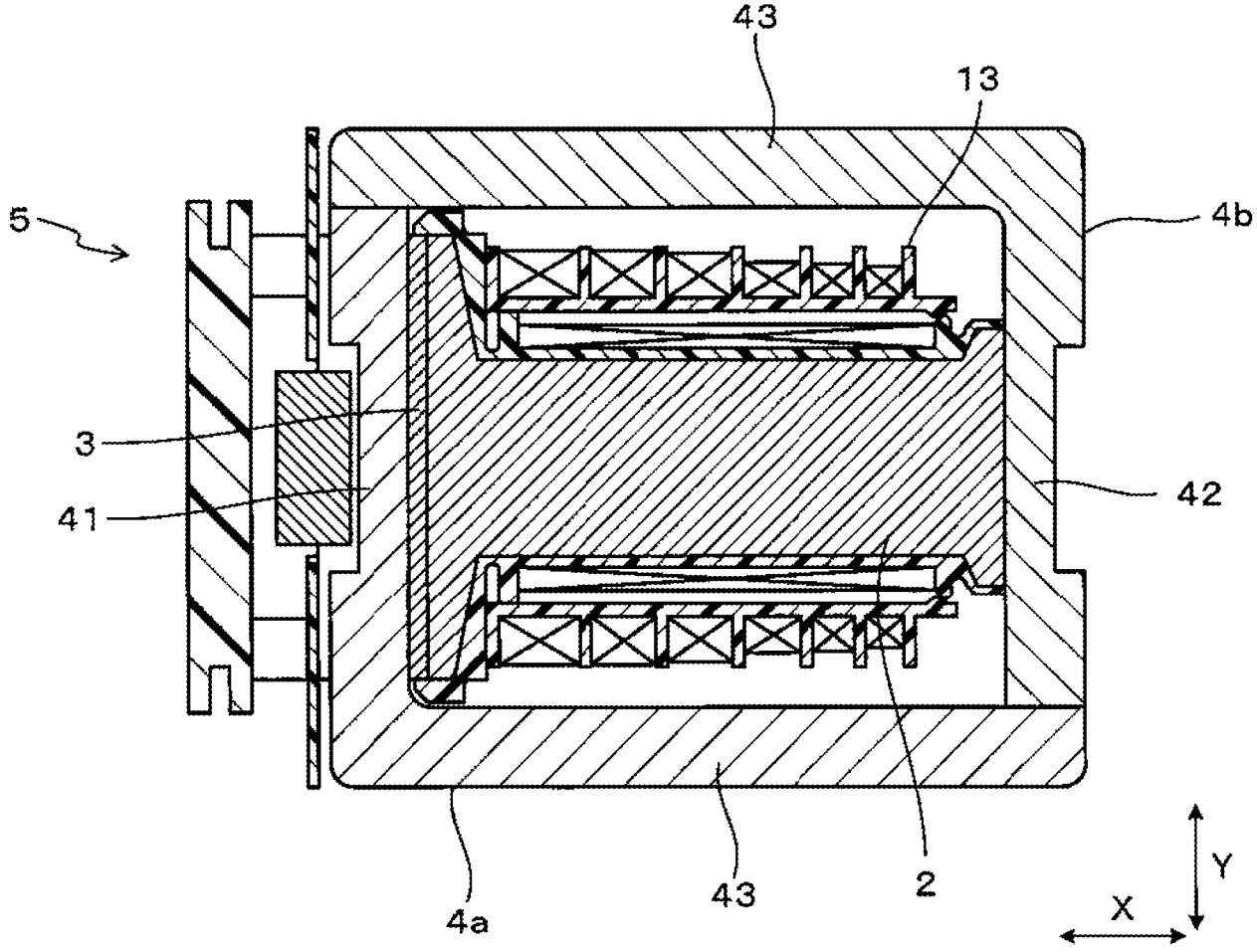
FIG. 20 is a cross-sectional view for explaining a state where the outer peripheral core is assembled to the connector module, showing a state where both the first divided core and the second divided core are assembled to the connector module.

Next, as shown in FIGS. 18 and 19, making the second divided core 4*b* approach the first divided core 4*a* in the Y direction, the second divided core 4*b* comes into contact with the first divided core 4*a*. Subsequently, as shown in FIGS. 19 and 20, the second divided core 4*b* is moved towards front side, whereby the second opposite side 42 of the second divided core 4*b* comes into contact with the rear surface of the center core 2. Thus, a gap is removed between the second opposite side 42 and the center core 2. As described, the secondary spool 13, the first divided core 4*a* and the second divided core 4*b* can be mounted to the connector module 5.

Next, effects and advantages of the present embodiment will be described. According to the present embodiment, the rear surface of the second opposite side 42 includes a rear concave portion 421 at a portion overlapping the rear surface of the center core 2 in the X direction. Hence, the rear concave portion 421 is provided, whereby the weight of the outer peripheral core 4 can be reduced, and also the manufacturing cost thereof can be reduced. Here, there is a concern that the magnetic resistance increases at a portion in the vicinity of the rear concave portion 421 of the second opposite side 42 since the rear concave portion 421 is formed at the second opposite side 42 so that a magnetic saturation is likely to occur in the corresponding region. In this respect, according to the present embodiment, a rear flange portion 23 is formed at the rear end portion of the center core 2, which protrudes outside the rear concave portion 421 in the Y direction. Thus, the cross sectional area orthogonal to the magnetic path formed in the center core 2 and the outer peripheral core 4 can be suppressed, thereby reducing the magnetic resistance in the magnetic path.

The portion where the rear flange portion 23 of the center core 2 in the X direction is formed when viewed from the X direction, is accommodated within the inner peripheral side with respect to the secondary spool 13. Hence, as described above, the secondary spool 13 can readily be mounted to the outer peripheral side of the center core 2.

Also, the outer peripheral core 4 is provided with a pair of coupling sides 43 and formed annularly, and configured by a combination of the first divided core 4*a* provided with the first opposite side 41 and the pair of coupling sides 43 and the second divided core 4*b* provided with the second opposite sides 42 and the other coupling side 43. Therefore, a gap is formed between the magnetic body 3 and the first opposite side 41, and between the rear surface of the center core 2 and the second side 42, whereby the magnetic resistance of the magnetic path constituted by the center core 2 and the outer peripheral core 4 can be prevented from being increased. The first divided core 4*a* and the second divided core 4*b* have the same shape. Accordingly, the productivity of the outer peripheral core 4 can readily be improved. Further, the same effects and advantages as those in the first embodiment can be obtained.

Eighth Embodiment

Figure 21:
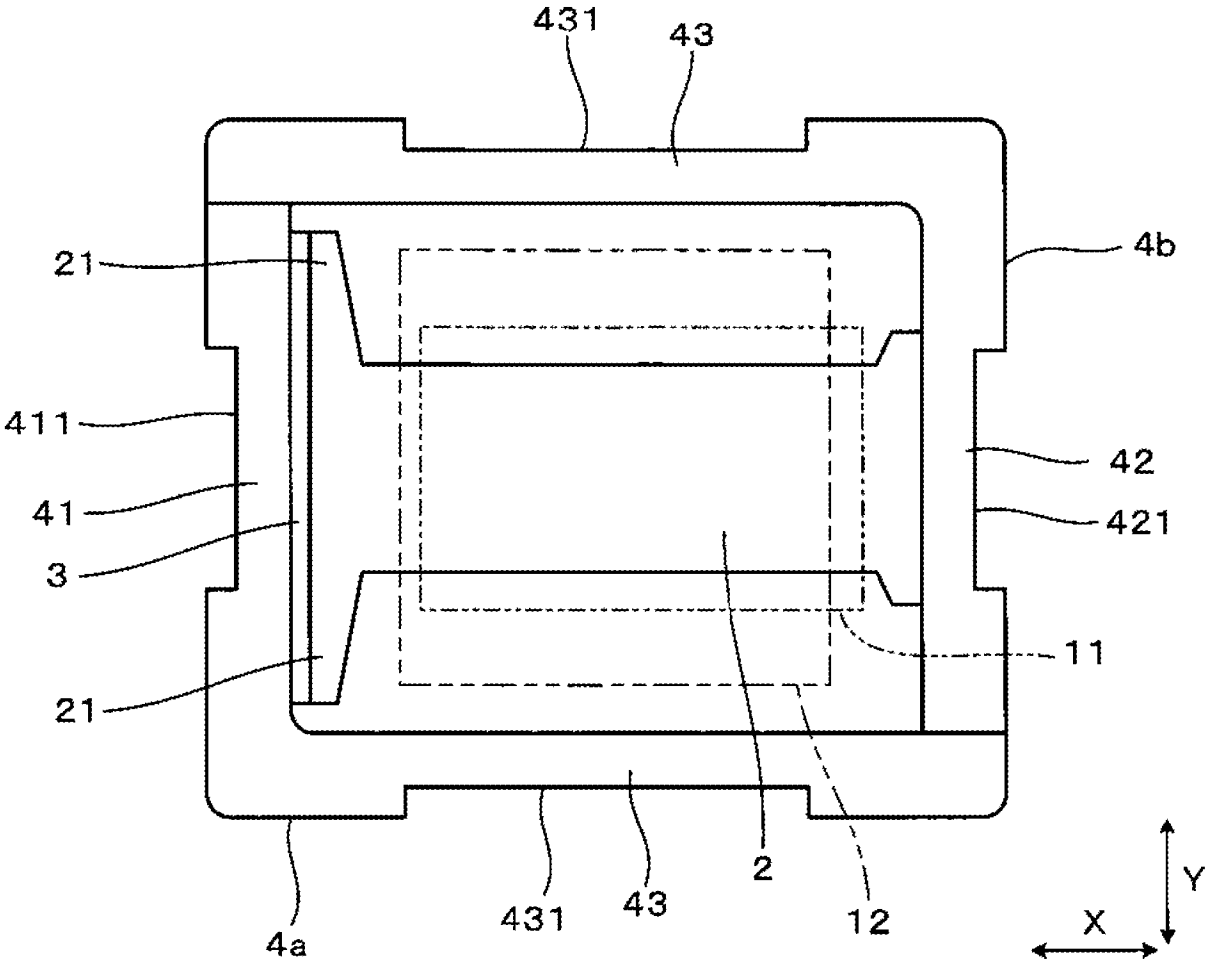
FIG. 21 is a cross-sectional view showing a center core, a magnet body and an outer peripheral core according to an eighth embodiment.

According to the present embodiment, as shown in FIG. 21, comparing with the seventh embodiment, a coupling concave portion 431 is added to the respective coupling side 43.

The coupling concave portion 431 serves as an outer side surface of the coupling side 43 in the Y direction and is formed at a center position in the X direction. The coupling concave portion 431 is opened at both sides in the Z direction. The coupling concave portion 431 is formed from the rear side with respect to the magnet side flange portion 21 to the front side with respect to the rear flange portion 23. Also, according to the present embodiment, the first divided core 4*a* and the second divided core 4*b* have the same shape. Other configurations are the same as those in the seventh embodiment.

According to the present embodiment, further weight reduction and cost reduction can be achieved. Further, the same effects and advantages as those in the seventh embodiment can be obtained.

Ninth Embodiment

Figure 22:
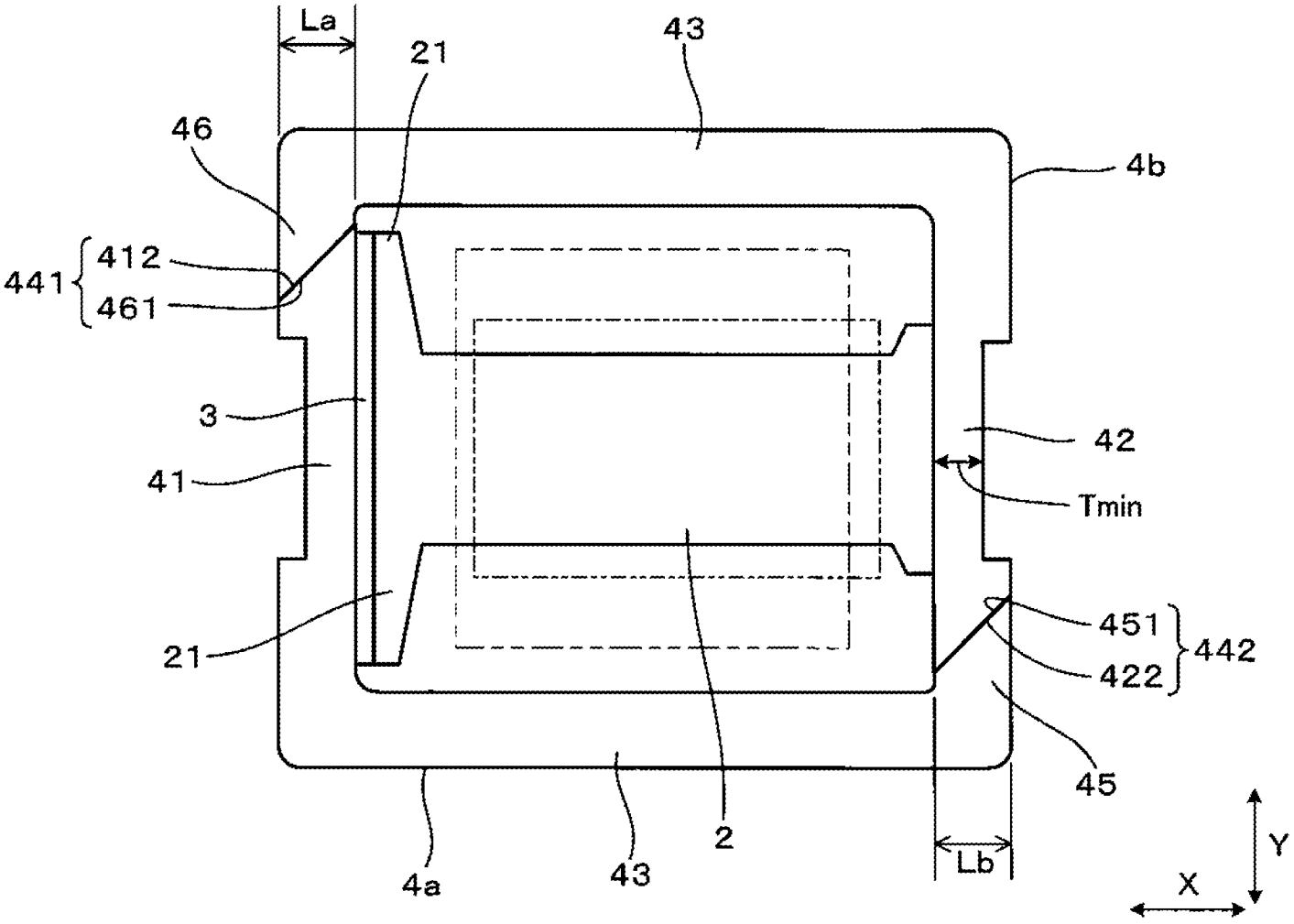
FIG. 22 is a cross-sectional view showing a center core, a magnet body and an outer peripheral core according to a ninth embodiment.

According to the present embodiment, as shown in FIGS. 22 to 25, comparing with the seventh embodiment, the shape of the contact portion between the first divided core 4*a* and the second divided core 4*b* is modified. As shown in FIG. 22, according to the present embodiment, the contact portion between the first opposite side 41 of the first divided core 4*a* and the coupling side 43 of the second divided core 4*b* is referred to as a first contact portion 441, and the contact portion between the second opposite side 42 of the second divided core 4*b* and the coupling side 43 of the first divided core 4*a* is referred to as a second contact portion 442.

The coupling side 43 of the second divided core 4*b* includes a second protrusion 46 protruding towards an end surface 412 side of the first opposite side 41 at a portion facing the end surface 412 of the first opposite side 41 in the first divided core 4*a* in the Y direction. The end surface 461 of the second protrusion 46 in the Y direction comes into contact with the end surface 412 of the first opposite side 41 to constitute the first contact portion 441.

The coupling side 43 of the first divided core 4*a* includes a first protrusion 45 protruding towards an end surface 422 side of the second opposite side 42 at a portion facing the end surface 422 of the second opposite side 42 in the second divided core 4*b* in the Y direction. The end surface 451 of the first protrusion 45 in the Y direction comes into contact with the end surface 422 of the second opposite side 42 to constitute the second contact portion 442.

Each of the first contact portion 441 and the second contact portion 442 is inclined towards a first divided core 4*a* side with respect to the second divided core 4*b* in the Y direction as it goes to the front side. Also, each of the first contact portion 441 and the second contact portion 442 is formed straight in a direction inclined towards both the X direction and the Y direction. The length La of the first contact portion 441 in the X direction and the length Lb of the second contact portion 442 in the X direction is larger than the minimum thickness Tmin of the second opposite side 42.

Figure 23:
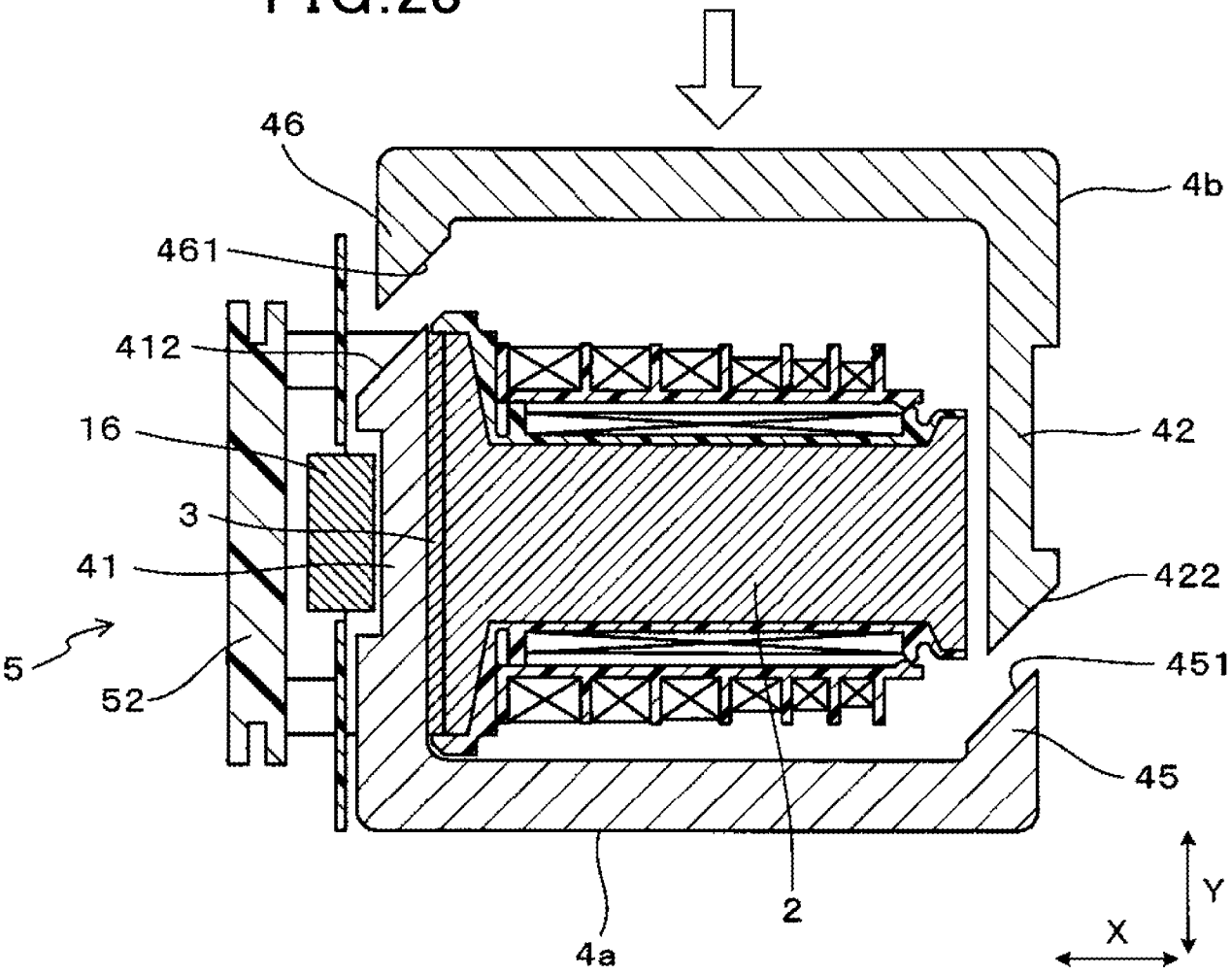
FIG. 23 is a cross-sectional view showing a state where the second divided core is assembled to the first divided core assembled to the connector module according to the ninth embodiment.
Figure 24:
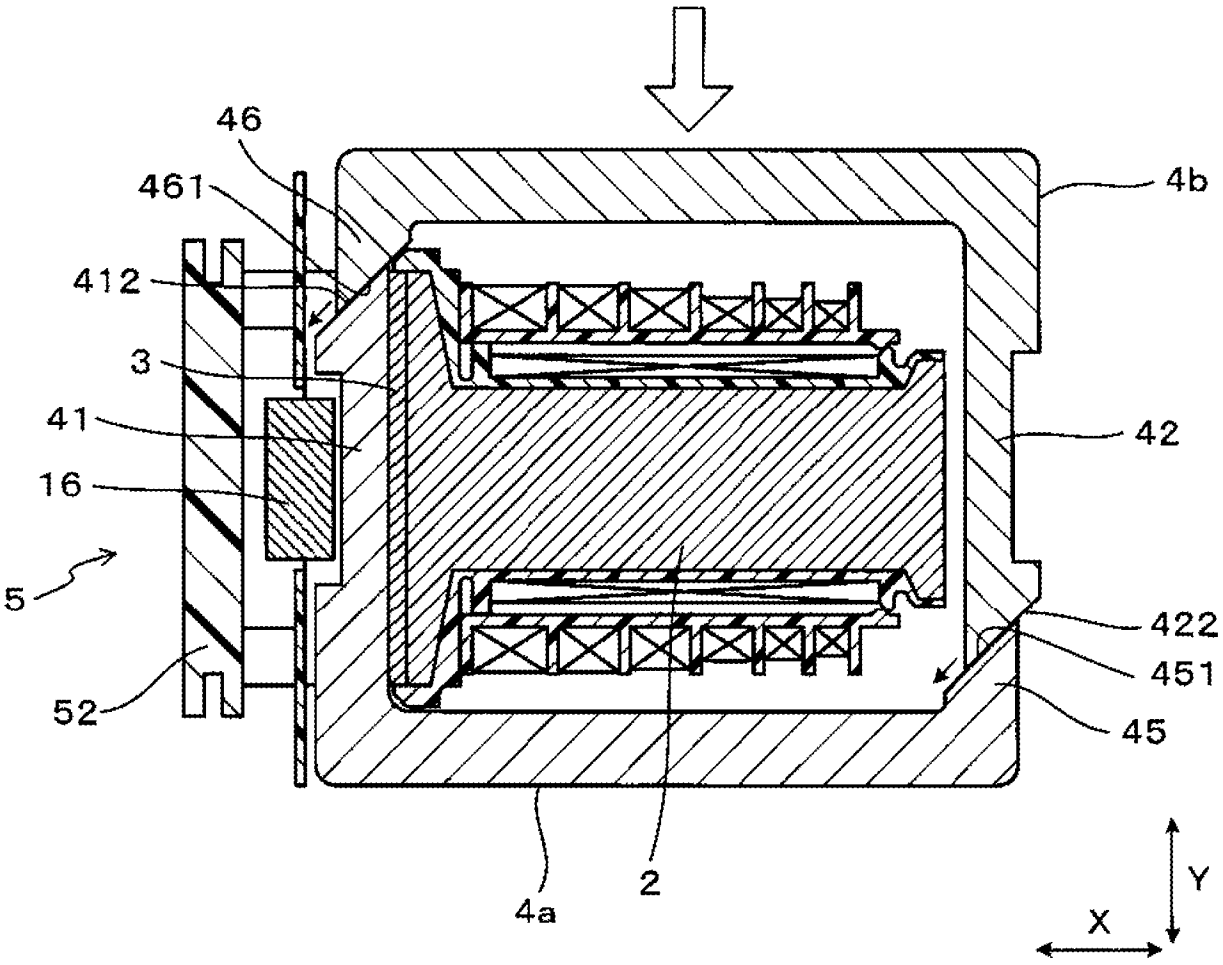
FIG. 24 is a cross-sectional view showing a state where the first divided core and the second divided core are contacted with each other according to the ninth embodiment.
Figure 25:
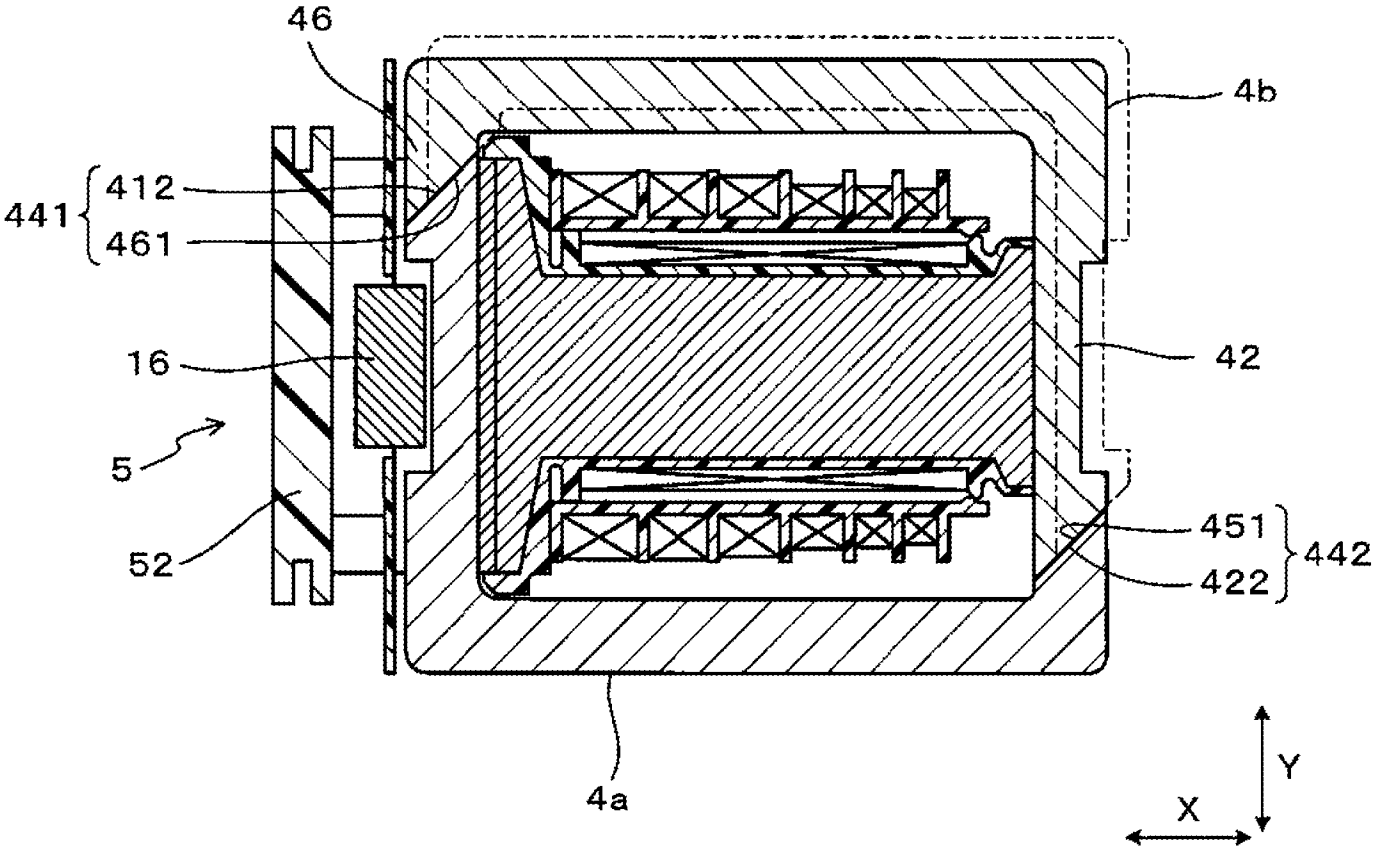
FIG. 25 is a cross-sectional view showing a state where the first divided core and the second divided core are positionally aligned with each other according to the ninth embodiment.

Next, as shown in FIGS. 23 to 25, an example of a method for mounting the first divided core 4*a* and the second divided core 4*b* to the connector module 5 will be described.

As shown in FIG. 23, the first divided core 4*a* is mounted to the connector module 5 such that the first opposite side 41 of the first divided core 4*a* is disposed in the front side of the magnet body 3 provided on the front surface of the center core 2. Then, the first opposite side 41 of the first divided core 4*a* is fixed to the magnet body 3 with the magnetic force.

Next, as shown in FIGS. 23 and 24, the second divided core 4*b* is mounted to the first divided core 4*a*. At this time, the second divided core 4*b* approaches the first divided core 4*a* in the Y direction, the end surface 422 of the second opposite side 42 of the second divided core 4*b* contacts with the end surface 451 of the first protrusion 45 of the first divided core 4*a*, and the end surface of the second protrusion 46 of the second divided core 4*b* contacts with the end surface 412 of the first opposite side 41 of the first divided core 4*a*. This state refers to a state shown in FIG. 24. In this state, a gap is formed between the second opposite side 42 of the second divided core 4*b* and the rear surface of the center core 2.

From this state, as shown in FIGS. 24 and 25, the second divided core 4*b* is further pressed in the Y direction such that the second divided core 4*b* approaches the first divided core 4*a*. Thus, for the second divided core 4*b*, the end surface 422 of the second opposite side 42 is slid on the end surface 451 of the first protrusion 45 of the first divided core 4*a*, and the end surface 461 of the second protrusion 46 is slid on the end surface 412 of the first opposite side 41. Thus, the second divided core 4*b* moves towards the first divided core 4*a* side in the Y direction and simultaneously moves towards the front side (i.e. moves in an oblique direction indicated by an arrow in FIG. 24). With this movement, as shown in FIG. 25, a portion between the first opposite side 41 and the second opposite side 42 is narrowed, and then the second opposite side 42 of the second divided core 4*b* comes into contact with the rear surface of the center core 2. Thus, the second divided core 4*b* is positioned in the X direction and the Y direction with respect to the first divided core 4*a*, in a state where the first opposite side 41 of the first divided core 4*a* is joined to the front surface of the magnet body 3 and the second opposite side 42 of the second divide core 4*b* is joined to the rear surface of the center core 2.

According to the present embodiment, an ignitor 16 and engaging wall 52 are present in the front side of the outer peripheral core 4 in a state of immediately before the first divided core 4*a* and the second divided core 4*b* are assembled (i.e. a state shown in FIG. 23). Hence, when positioning the first divided core 4*a* and the second divided core 4*b* in the X direction, it is difficult to press the first divided core 4*a* and the second divided core 4*b* in the X direction. On the other hand, according to the present embodiment, the second divided core 4*b* is only pressed from the Y direction, whereby the first divided core 4*a* and the second divided core 4*b* can be positioned in both of the X direction and the Y direction, while making the front surface of the magnet body 3 and the first opposite side 41 contact and making the rear surface of the center core 2 and the second opposite side 42 contact. Accordingly, the productivity of the ignition coil 1 can be improved.

Next, effects and advantages of the present embodiment will be described. In the ignition coil 1 of the present embodiment, each of the first contact portion 441 and the second contact portion 442 is positioned towards a first divided core 4*a* side with respect to the second divided core 4*b* in the Y direction as it goes to the front side. Hence, when mounting the first divided core 4*a* and the second divided core 4*b* to the center core 2 and the magnet body 3, for example, the above-described method is applied, whereby the productivity of the ignition coil 1 can be improved as described above.

Also, the magnet body 3 is provided between the front surface of the center core 2 and the first opposite side 41 of the first divided core 4*a*. Hence, the productivity of the ignition coil 1 can readily be improved. In other words, when assembling the center core 2, the magnet body 3, the first divided core 4*a* and the second divided core 4*b*, the magnet body 3 is disposed on the front surface of the center core 2 and the first divided core 4*a* is disposed on the front surface of the magnet body 3, whereby the center core 2, the magnet body 3 and the first divided core 4*a* are integrated with the magnetic force of the magnet body 3. Then, the second divided core 4*b* may be mounted to the first divided core 4*a* which has been integrated with the center core 2 and the magnet body 3.

Here, because of variation in the dimension of the first divided core 4*a* and the second divided core 4*b*, the end surface of the first opposite side 41 and the end surface of the second protrusion 46 may be shifted therebetween and the end surface of the first protrusion 45 and the end surface of the second opposite side 42 may be shifted therebetween. In the case where a shift occurs between them, a problem arises that an area in which the first divided core 4*a* and the second divided core 4*b* face each other becomes smaller and magnetic flux tends to leak at the outer peripheral core 4.

In this respect, the length La in the X direction of at least one of the end surface 412 of the first opposite side 41 and the end surface 461 of the second protrusion 46 which constitute the first contact portion 441 is set to be longer than the minimum thickness T min of the second opposite side 42. Further, the length Lb in the X direction of at least one of the end surface 422 of the second opposite side 42 and the end surface 451 of the first protrusion 45 which constitute the second contact portion 442 is set to be longer than the minimum thickness T min of the second opposite side 42. Thus, an area where the end surface 412 of the first opposite side 41 and the end surface 461 of the second protrusion 46 are faced with each other and an area where the end surface 422 of the second opposite side 42 and the end surface 451 of the first protrusion 45 are faced with each other can readily be secured, and the magnetic flux is prevented from being leaked from the outer peripheral core 4. Hence, the performance of the ignition coil 1 can be prevented from being lowered.

Moreover, the first contact portion 441 and the second contact portion 442 are each formed in a planar shape and formed to be parallel each other. Hence, contact areas for respective first contact portion 441 and the second contact portion 442 can readily be secured. Accordingly, the performance of the ignition coil 1 can be prevented from being lowered.

The coupling side 43 of the first divided core 4*a* includes a first protrusion 45, and the coupling side 43 of the second divided core 4*b* includes a second protrusion 46. The end surface 451 of the first protrusion 45 constitutes the second contact portion 442, and the end surface 461 of the second protrusion 46 constitutes the first contact portion 441. Thus, the first portion 441 and the second contact portion 442 can be configured with a simple shape.

Further, the entire end surface 451 of the first protrusion 45 is formed at a position away from the coupling side 43 of the first divided core 4*a* in the Y direction, and the entire end surface 461 of the second protrusion 46 is formed at a position away from the coupling side 43 of the second divided core 4*b* in the Y direction. Thus, when causing the first divided core 4*a* and the second divided core 4*b* to slide on the first contact portion 441 and the second contact portion 442 to be assembled, a slide between the first divided core and the second divided core can be prevented from being disturbed by the first divided core 4*a* coming into contact with the coupling side 43 of the second divided core 4*b* or the second divided core 4*b* coming into contact with the coupling side 43 of the first divided core 4*a*.

Example of Experiment

This example utilizes a simulation resulting that S1 [$mm^2$], S2 [$mm^2$], L and D preferably satisfy a condition of $(2\times S2)/S1 \geq -0.189L+0.086D+1.998$. As described above, the area S1 is, as shown in FIG. 4, a cross-sectional area orthogonal to the X direction in the insertion portion 221 of the center core 2. As shown in FIG. 4, the area S2 is a cross-sectional area of the thick portion 40 orthogonal to the magnetic path of the outer peripheral core 4. As shown in FIG. 3, the distance L refers to a distance between the magnet side flange portion 21 in the Y direction and the coupling side 43. As shown in FIG. 4, the distance D refers to a distance between the center of the insertion portion 221 of the center core 2 and the center of the outer peripheral core 4.

In this example, as shown in FIG. 7, $(2\times S2/S1)$ in the left side of the above-described equation and the distance L [mm], the distance D [mm] in the right side of the above-described equation are variously changed.

In this example, an ambient temperature of the ignition coil 1 is determined as a room temperature. Then, 10A of primary current is caused to flow through the primary coil 11 of the ignition coil 1, and a secondary energy produced in the secondary coil 12 side is confirmed when the primary current is cutoff. The winding resistance of the secondary coil 12 is set to be 5 kΩ and the discharge sustaining voltage is set to be 800 volts.

Firstly, the distance D is fixed to D=2.95 mm, and term $(2\times S2)/S1$ and the distance L are variously changed, and confirmed the secondary energy E2 [mJ]. For the term $(2\times S2)/S1$, S1 is not changed and S2 is variously changed. The distance L is set to be any one of values of 0.2 mm. 0.7 mm. 1.2 mm, 1.7 mm, 2.2 mm and 3.2 mm. The experiment result is shown in FIG. 26.

Figure 26:
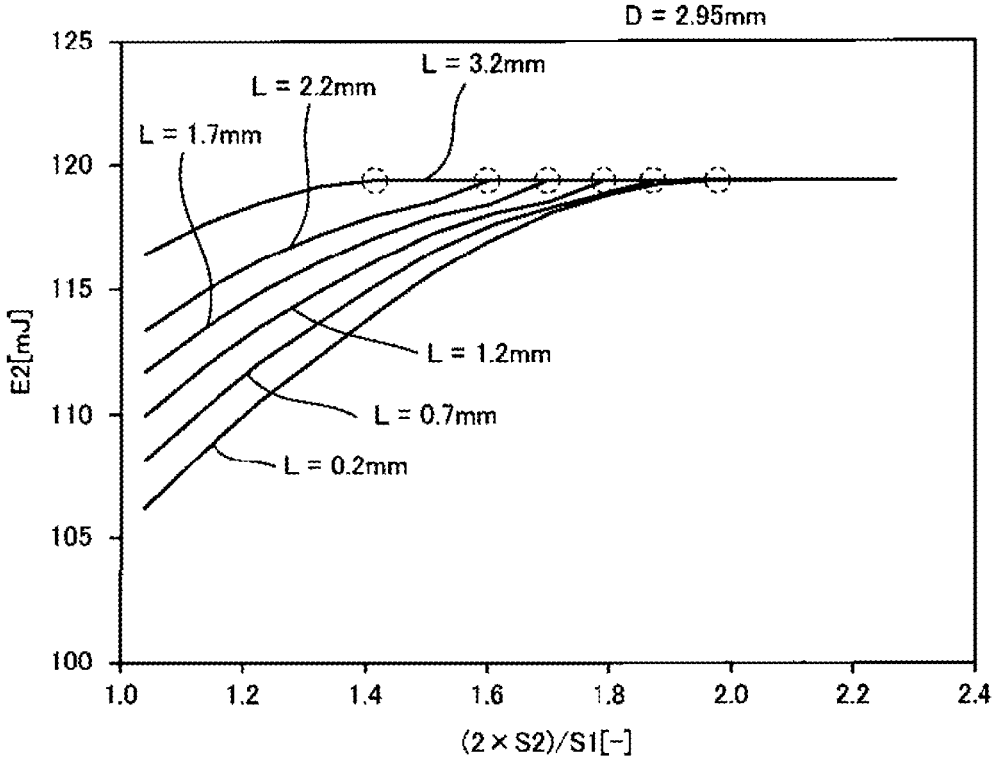
FIG. 26 is a graph showing a relationship between a factor $(2\times S2)/S1$ and a secondary energy E2 in the case where D=2.95 mm.

In FIG. 26, it can be seen that the secondary energy E2 is unlikely to increase in the case where the value of $(2\times S2)/S1$ exceeds a saturation start value (i.e. circles surrounded by dotted lines shown in FIG. 26). In other words, when the value of $(2\times S2)/S1$ is the saturation start value or more, acquirable maximum secondary energy E2 can be obtained.

Figure 27:
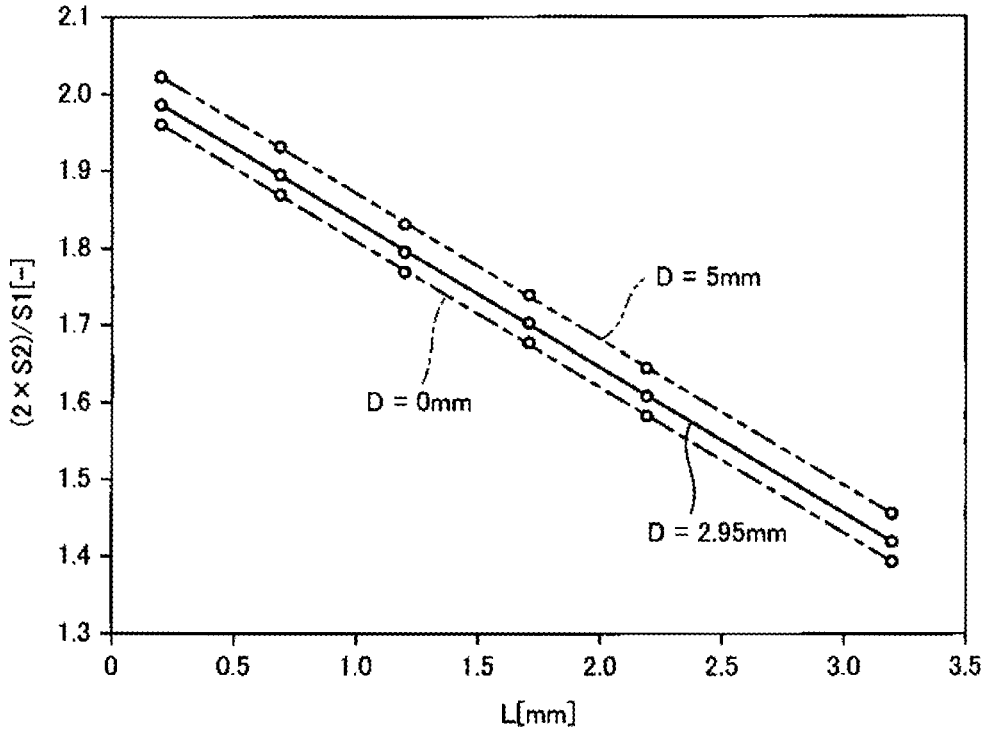
FIG. 27 is graph showing a relationship between L and a factor $(2\times S2)/S1$ in which a saturation start value shown in FIG. 26 is plotted corresponding to respective cases of D=0 mm, 2.95 mm and 5 mm.

In this respect, the saturation start value of $(2\times S2)/S1$ where D=2.95 mm (i.e. fixed value) is plotted in the graph shown in FIG. 27 where the horizontal axis is L and the vertical axis is $(2\times S2)/S1$. Specifically, according to the graph shown in FIG. 27, the value of $(2\times S2)/S1$ exceeds the above-described saturation start value when it is in an upper region with respect the solid line indicating the result of the plot with D=2.95 mm, the value of $(2\times S2)/S1$ exceeds the above-described saturation start value, thereby obtaining the maximum secondary energy. The solid line shown in FIG. 27 indicating the result of the plot with D=2.95 mm is determined as a linear line expressed by substituting 2.95 for D in a line of $(2\times S2)/S1=-0.189L+0.086D+1.998$ where the sign of equal is substituted for the sign of inequality in the above-described equation $(2\times S2)/S1\geq-0.189L+0.086D+1.998$.

With the above-described procedure, coefficient D is changed to fixed values of 0 mm and 5 mm and the results were shown in FIG. 7 as a chain line plot for D=0 mm and a two-dot chain line plot for D=5 mm. The chain line shown in FIG. 27 indicating the result of the plot with D=0 mm is determined as a linear line expressed by substituting 0 for D in a line of $(2\times S2)/S1=-0.189L+0.086D+1.998$ where the sign of equal is substituted for the sign of inequality in the above-described equation $(2\times S2)/S1\geq-0.189L+0.086D+1.998$. Further, a two-dot chain line shown in FIG. 27 indicating the result of the plot with D=5 mm is determined as a linear line expressed by substituting 5 for D in the line of $(2\times S2)/S1=-0.189L+0.086D+1.998$ where the sign of equal is substituted for the sign of inequality in the above-described equation $(2\times S2)/S1\geq-0.189L+0.086D+1.998$. As a result, in view of securing the secondary energy, the equation $(2\times S2)/S1\geq-0.189L+0.086D+1.998$ may preferably be satisfied. Moreover, it is preferable to satisfy the equation $(2\times S2)/S1=-0.189L+0.086D+1.998$, since the secondary energy is secured while making the area S2 smaller (i.e. while making the outer peripheral core 4 to be smaller size).

Note that the distance L may preferably be set to satisfy a condition of $L\leq1.0$ min. When the distance L is smaller than or equal to 1.0 mm, the coupling side 43 of the outer peripheral core 4 and the magnet side flange portion 21 of the center core 2 approach each other so that the magnetic-flux loop which does not contribute the energy conversion is likely to occur. Therefore, significant effects are obtained from forming the thick portion 40.

The present disclosure is not limited to the above-described embodiments, but may be applied to various embodiments without departing from the spirit of the present disclosure.

For example, in the respective embodiments, the outer peripheral core is formed annularly having a pair of coupling sides. However, for example, the outer peripheral core may be formed to have one coupling side and formed in a substantially U-shape as a whole. Also, in the respective embodiments, the magnet side flange portion protrudes towards both sides in the coil axial direction. However, it is not limited thereto. For example, the magnet side flange portion may be formed to protrude towards only one side in the direction orthogonal to the coil axial direction. Further, the magnet side flange portion may be formed to protrude in a specific direction orthogonal to the coil axial direction and also a direction orthogonal to both of the coil axial direction and the specific direction. For the rear flange portion described in the seventh embodiment to the nineth embodiment, similar modifications to the magnet side flange portion.

(Conclusion)

The present disclosure has been achieved in light of the above-described circumstances and provides an ignition coil capable of suppressing an energy loss when converting the primary energy into the secondary energy.

A first aspect of the present disclosure is an ignition coil (1) including: a primary coil (11) and a secondary coil (12) magnetically coupled with each other; a center core (2) disposed at an inner peripheral side of the primary coil and the secondary coil with respect to a coil axial direction (X); a magnet body (3) disposed at one side of the center core in the coil axial direction (X); and an outer peripheral core (4) provided with a first opposite side (41), a second opposite side (42) and a coupling side (43), the first opposite side facing the magnet body from an opposite side of the center core, the second opposite side facing the center core from the opposite side of the magnet body, the coupling side coupling the first opposite side with the second opposite side.

The center core has a magnet side flange portion (21) disposed at an end portion in a magnet body side, protruding in a protrusion direction (Y) orthogonal to the coil axial direction; and a thick portion (40) is formed at at least a part of the first opposite side which overlaps the magnet side flange portion in the coil axial direction and at least a part of the coupling side which overlaps at least either the magnet side flange portion or the magnet body in the protrusion direction, a thickness of the thick portion being larger than a minimum thickness of the second opposite side.

According to the ignition coil of the first aspect, a thick portion is formed at at least a part of the first opposite side which overlaps the magnet side flange portion in the coil axial direction and at least a part of the coupling side which overlaps at least either the magnet side flange portion or the magnet body in the protrusion direction. The thickness of the thick portion is larger than the minimum thickness of the second opposite side. Thus, the thick portion is formed at a portion where magnetic saturation is likely to occur in the outer peripheral core, whereby the energy loss when converting the primary energy to the secondary energy can be suppressed.

As described, according to the above-described aspect, an ignition coil is provided in which the energy loss can be suppressed when converting the primary energy into the secondary coil. Note that the reference numbers in parentheses attached to each component or the like indicate an example of the correspondence between the components or the like and the specific components or the like in the embodiments described later, which will not limit the technical scope of the present disclosure.

What is claimed is:

1. An ignition coil comprising:

a primary coil and a secondary coil magnetically coupled with each other;

a center core disposed at inner peripheral side of the primary coil and the secondary coil with respect to a coil axial direction;

a magnet body disposed at one side of the center core in the coil axial direction; and an outer peripheral core provided with a first opposite side, a second opposite side and a coupling side, the first opposite side facing the magnet body from an opposite side of the center core, the second opposite side facing the center core from the opposite side of the magnet body, the coupling side coupling the first opposite side with the second opposite side, wherein the center core has a magnet side flange portion disposed at an end portion in a magnet body side, protruding in a protrusion direction orthogonal to the coil axial direction; and a thick portion is formed at at least a part of the first opposite side which overlaps the magnet side flange portion in the coil axial direction and at least a part of the coupling side which overlaps at least either the magnet side flange portion or the magnet body in the protrusion direction, a thickness of the thick portion being larger than a minimum thickness of the second opposite side.

2. The ignition coil according to claim 1, wherein a concave portion is provided at a surface of the second opposite side, the surface of the second opposite side being opposite to the center core;

the concave portion is disposed at a portion overlapping with a surface of the center core in the second opposite side with respect to the coil axial direction; and an end portion of the center core which opposes the magnet body has an anti-magnet side flange portion protruding outside the concave portion in a direction orthogonal to the coil axial direction.

3. The ignition coil according to claim 2, wherein the ignition coil further comprising a secondary spool in which the secondary coil is wound around; and a region where the anti-magnet side flange portion of the center core in the coil axial direction is present is formed to be accommodated within an inner peripheral side of the secondary spool when viewed in the coil axial direction.

4. The ignition coil according to claim 2, wherein the outer peripheral core is formed annularly having a pair of the coupling sides, and configured by a combination of a first divided core provided with the first opposite side and one of the pair of coupling sides and a second divided core provided with the second opposite side and the other one of the pair of coupling sides; and the first divided core and the second divided core have the same shape.

5. The ignition coil according to claim 1, wherein the outer peripheral core is formed annularly having a pair of the coupling sides; and a condition of $$(2\times S2)/S1\geq -0.189L+0.086D+1.998$$

is satisfied, wherein S1 [$mm^2$] is a cross-sectional area orthogonal to the coil axial direction in an insertion portion of the center core positioned at inner peripheral side of the primary coil and the secondary coil, S2 [$mm^2$] is cross-sectional area of the thick portion orthogonal to a magnetic path of the outer peripheral core, L [mm] is a distance between the magnet side flange portion and the coupling side in an arrangement direction in which the coupling side and the center core are arranged, and D [mm] is a distance between a center of the insertion portion and the center of the outer peripheral core in a direction orthogonal to both of the arrangement direction and the coil axial direction.

* * * * *